US005940997A

United States Patent [19]

Toyooka et al.

[11] Patent Number: 5,940,997

[45] Date of Patent: Aug. 24, 1999

[54] HYDRAULIC CIRCUIT SYSTEM FOR HYDRAULIC WORKING MACHINE

[75] Inventors: Tsukasa Toyooka, Ibaraki-ken; Toichi Hirata, Ushiku; Genroku Sugiyama, Ibaraki-ken; Kazunori Nakamura, Ibaraki-ken; Kouji Ishikawa, Ibaraki-ken; Tsuyoshi Nakamura, Ibaraki-ken, all of Japan

[73] Assignee: Hitachi Construction Machinery Co., Ltd., Tokyo, Japan

[21] Appl. No.: 09/145,158

[22] Filed: Sep. 1, 1998

[30] Foreign Application Priority Data

| | | | |
|---|---|---|---|
| Sep. 5, 1997 | [JP] | Japan | 9-241107 |
| Sep. 5, 1997 | [JP] | Japan | 9-241108 |
| Feb. 12, 1998 | [JP] | Japan | 10-029804 |

[51] Int. Cl.[6] ..... E02F 9/22

[52] U.S. Cl. ..... 37/411; 37/466

[58] Field of Search ..... 37/411, 234, 466; 172/2

[56] References Cited

U.S. PATENT DOCUMENTS

| | | | |
|---|---|---|---|
| 3,631,615 | 1/1972 | Reinsma | 37/411 |
| 4,506,464 | 3/1985 | Cartner | 37/234 X |
| 4,999,935 | 3/1991 | Simi et al. | 37/234 X |
| 5,210,964 | 5/1993 | Lam et al. | 37/411 |
| 5,265,356 | 11/1993 | Winter | 37/234 |
| 5,361,519 | 11/1994 | Ciula et al. | 37/234 |

FOREIGN PATENT DOCUMENTS

| | | |
|---|---|---|
| 3-144024 | 6/1991 | Japan . |
| 2534897 | 6/1996 | Japan . |

*Primary Examiner*—Christopher J. Novosad

*Attorney, Agent, or Firm*—Fay, Sharpe, Beall, Fagan, Minnich & McKee

[57] ABSTRACT

A hydraulic circuit system includes a shuttle block, and shuttle valves are arranged and connected within the shuttle block. The maximum pressure in a predetermined operation signal pressure group selected from operation signal pressures generated by pilot operating units is selected to produce a control signal pressure within the shuttle block. The control signal pressure is output to control devices such as a track communicating valve, a swing brake cylinder, and regulators for hydraulic pumps.

15 Claims, 22 Drawing Sheets

HYDRAULIC CIRCUIT SYSTEM FOR HYDRAULIC WORKING MACHINE

BACKGROUND OF THE INVENTION

1. Field of the Invention

The present invention relates to a hydraulic circuit system for hydraulic working machine such as a hydraulic excavator, and more particularly to a hydraulic circuit system for hydraulic working machine in which the maximum of predetermined ones of operation signal pressures generated by a plurality of pilot operating units is detected by shuttle valves, and the detected maximum pressure is used as a control signal pressure to operate a control device such as a regulator for a hydraulic pump.

2. Description of the Prior Art

JP, B2, 2534897 and JP, A, 3-144024 disclose examples of a hydraulic circuit system in which the maximum of predetermined ones of operation signal pressures generated by a plurality of pilot operating units is detected by shuttle valves, and the detected maximum pressure is used as a control signal pressure to operate a control device.

FIG. 21 shows the hydraulic circuit system disclosed in JP, B2, 2534897. The disclosed hydraulic circuit system includes, as the control device operated by the control signal pressure, a regulator for controlling a tilting of a hydraulic pump.

More specifically, in FIG. 21, a hydraulic fluid delivered from a variable displacement hydraulic pump 101 is supplied to and returned from actuators 105, 106, 107 through flow control valves 102, 103, 104, respectively. Pilot operating units 108, 109, 110 are provided for the actuators 105, 106, 107, respectively. The pilot operating units 108, 109, 110 include pilot valves (pressure reducing valves) built therein, and generate operation signal pressures from the pressure of a pilot pump 100 depending on the direction and input amount in and by which respective control levers are manipulated, the operation signal pressures being supplied so as to act on the corresponding flow control valves 102, 103, 104. The maximum of the operation signal pressures generated by the pilot operating units 108, 109, 110 is detected by shuttle valves 111, 112, 113, 114 and 115. The detected maximum pressure is transmitted as a control signal pressure to a regulator 116 for the hydraulic pump 101. The regulator 116 is thereby operated to control a tilting, i.e., a delivery capacity, of the hydraulic pump 101.

Further, the hydraulic circuit system disclosed in JP, A, 3-144024 includes a merging/branching circuit selector valve for two hydraulic pumps which is a control device operated by a control signal pressure, and two valve blocks, i.e., a shuttle valve block and a pilot selector valve block, which serve as means for extracting, as the control signal pressure, the maximum in a group of operation signal pressures. The shuttle valve block detects the maximum for each of a plurality of operation signal pressure groups selected from among from the operation signal pressures generated by a plurality of pilot operating units, the detected maximum pressures being introduced to the pilot selector valve block. The pilot selector valve block extracts one of the maximum pressures selected by the shuttle valve block with a combination of shuttle valves and pilot selector valves which are provided in the pilot selector valve block. The extracted maximum pressure is introduced, as the control signal pressure, to the merging/branching circuit selector valve, whereupon the merging/branching circuit selector valve is shifted.

SUMMARY OF THE INVENTION

In the conventional hydraulic circuit systems, as stated above, the maximum in the predetermined operation signal pressure group selected from operation signal pressures generated by pilot operating units is detected by a plurality of shuttle valves, and the detected maximum pressure is used as a control signal pressure to operate a control device such as a regulator for a hydraulic pump. When assembling such hydraulic circuit systems in practice, there arises a problem of where the shuttle valves are to be arranged.

In the hydraulic circuit system disclosed in JP, B2, 2534897, the shuttle valves 111, 112, 113, 114 and 115 are illustrated on the drawing as being disposed near the pilot operating units 108, 109, 110 and connected to them through piping lines. When arranging and connecting a number of shuttle valves practically in such a manner, however, a large space is required to install the shuttle valves and the piping lines, and setup work of the piping lines is complicated. In the case employing a plurality of control devices, particularly, the piping lines cross each other in a more complicated way. It is therefore difficult to install the disclosed hydraulic circuit system on an actual machine from the standpoints of space, cost and assembling efficiency. Additionally, because the length of the piping lines is increased, there occurs a pressure loss and there may occur a response delay in operation of the control device.

In view of the above, it is conceivable to utilize a valve block of the flow control valves 102, 103, 104 for installing the above-mentioned shuttle valves such that the shuttle valves are incorporated in the valve block.

However, incorporating the shuttle valves in the a valve block would raise a problem as discussed below. The flow control valves 102, 103, 104 handle a high hydraulic pressure reaching to 350 kg/cm$^2$ at a maximum level, and therefore the valve block of the flow control valves must be made of a material having high strength sufficiently endurable to such a high level of pressure. On the other hand, the shuttle valves handle a pilot pressure as low as 50–60 kg/cm$^2$ at maximum. Accordingly, if the shuttle valves are incorporated in the valve block together, the valve block made of a high-pressure endurable material must be increased in size despite that the hydraulic pressure handled by the shuttle valves is low. The shuttle valves would be thus very expensive.

In the hydraulic circuit system disclosed in JP, A, 3-144024, since the shuttle valve block and the pilot selector valve block are provided separately from the valve block of the flow control valves, the above-stated problem does not occur substantially. With the disclosed prior art, however, since two valve blocks, i.e., the shuttle valve block and the pilot selector valve block, are provided and shuttle valves are incorporated in each of the valve blocks to create the control signal pressure from a plurality of operation signal pressures, there are necessary two valve blocks and piping lines for connection between the two blocks; hence a large installation space is required. Accordingly, setup work of the piping lines is complicated and assembling efficiency is deteriorated. In addition, since the presence of the piping lines required for connection between the two blocks causes a pressure loss, there may occur a response delay in operation of the control device (the merging/branching circuit selector valve). Stated otherwise, the problem encountered in the prior art shown in FIG. 21 cannot be overcome.

Moreover, in any of the above-described prior arts, the flow control valve and the control device are both operated in accordance with the operation signal pressures generated by the pilot operating units. The length of a transmission line for the operation signal pressure is so increased that a flow rate providing the signal pressure becomes relatively insufficient for a capacity of the long transmission line. For this reason, there may also occur a response delay in operation of the control device. In such a case, there may occur a response delay in shifting of the flow control valve as well.

Further, in a hydraulic working machine such as a hydraulic excavator, retrofit is often desired to additionally provide an actuator in an existing hydraulic circuit system for the purpose of achieving a higher function. Adding an actuator to the hydraulic circuit system shown in FIG. 21 requires that the hydraulic pump 101 can also be controlled for the added actuator. FIG. 22 shows a circuit configuration after the hydraulic circuit system shown in FIG. 21 has been retrofitted to add an actuator. In FIG. 22, denoted by 117 is the added actuator. A flow control valve 118 and a pilot operating unit 119 are also added in association with the actuator 117. Further, shuttle valves 120, 121 are added in association with the pilot operating unit 119, and piping lines such as hoses are set up for connection of the flow control valve, the pilot operating unit, and the shuttle valves. With the above construction, the added actuator 117 can also be operated such that when the pilot operating unit 119 is manipulated, the regulator 116 is operated to increase a delivery capacity, i.e., a delivery rate, of the hydraulic pump 101.

For adding the actuator 117, however, it is required to not only add the shuttle valves 120, 121 as well as the flow control valve 118 and the pilot operating unit 119, but also carry out work for connecting those members through piping lines such as hoses. In other words, a large amount of labor and time are necessary to add an actuator.

While the above description has been made of the case where the hydraulic circuit system includes a regulator for capacity control of a hydraulic pump, a similar problem arises in any hydraulic circuit system including a control device which is operated in accordance with a maximum pressure detected by one or more shuttle valves.

A first object of the present invention is to provide a hydraulic circuit system for a hydraulic working machine which includes a control device operated by a control signal pressure in accordance with a maximum pressure detected by shuttle valves, wherein a high-pressure system and a low-pressure system are separated from each other to simplify a circuit configuration, reduce a production cost, and ensure good assembling efficiency.

A second object of the present invention is to provide a hydraulic circuit system for a hydraulic working machine which includes a control device operated by a control signal pressure in accordance with a maximum pressure detected by shuttle valves, wherein a pressure loss during transmission of the control signal pressure is reduced and the control device can be operated with a good response.

A third object of the present invention is to provide a hydraulic circuit system for a hydraulic working machine which includes a control device operated by a control signal pressure in accordance with a maximum pressure detected by shuttle valves, wherein the control signal pressure can be generated without increasing the length of a transmission line for the control signal pressure, and flow control valves and the control device can be both operated with a good response.

A fourth object of the present invention is to provide a hydraulic circuit system for a hydraulic working machine which includes a control device operated by a control signal pressure in accordance with a maximum pressure detected by shuttle valves, wherein when the system is retrofitted to provide an additional actuator, the control device corresponding to the additional actuator can be simply operated.

To achieve the above first and second objects, according to the present invention, there is provided a hydraulic circuit system for a hydraulic working machine comprising at least one hydraulic pump, a plurality of actuators, a plurality of flow control valves for supplying a hydraulic fluid delivered from the hydraulic pump to the plurality of actuators, a pilot hydraulic source, a plurality of pilot operating units for generating operation signal pressures from a pressure of the pilot hydraulic source to shift the corresponding flow control valves, and a plurality of shuttle valves for selecting a maximum pressure for each of at least one of predetermined operation signal pressure groups selected from the operation signal pressures generated by the plurality of pilot operating units, the system producing at least one control signal pressure in accordance with the maximum pressure selected by the plurality of shuttle valves from the at least one predetermined operation signal pressure group, thereby operating at least one control device associated with any of the hydraulic pump, the actuators and the flow control valves, wherein the plurality of shuttle valves for selecting the maximum pressure are all built in one shuttle block, and the control signal pressure is produced within the shuttle block and then output to the control device.

By incorporating the plurality of shuttle valves in the shuttle block and producing the control signal pressure within the shuttle block to be output from it, a low-pressure system of the shuttle valves is perfectly separated from a high-pressure system of the flow control valves. Accordingly, a valve block of the flow control valves, which is made of a high-strength material, can have a small size. In addition, a shuttle block body which serves as a common valve block of the shuttle valves can be made of an inexpensive material. As a result, the overall production cost can be cut down.

Further, since the shuttle valves are all built in one shuttle block, piping lines between the shuttle valves are no longer required and therefore the circuit configuration is simplified. Accordingly, assembling efficiency of the hydraulic circuit system is improved and a pressure loss during the transmission of the signal pressures is minimized, resulting in that the control device can be operated with a good response.

To achieve the above third object, preferably, the above hydraulic circuit system for hydraulic working machine further comprises a hydraulic selector valve operated in accordance with the maximum pressure selected by the plurality of shuttle valves from at least one of the predetermined operation signal pressure groups, thereby producing a corresponding control signal pressure from the pressure of the pilot hydraulic source, the hydraulic selector valve being also built in the shuttle block.

By operating the hydraulic selector valve, which is built in the shuttle block, in accordance with the maximum pressure selected by the shuttle valves and producing the control signal pressure from the pressure of the pilot hydraulic source, the operation signal pressure selected as the maximum pressure by the shuttle valves is utilized just in a limited passage within the shuttle block for being used for the control device. Therefore, the length of a transmission line of the operation signal pressure selected as the maximum pressure by the shuttle valves is not so increased and one or more corresponding flow control valves can be shifted with a good response. On the other hand, from the point of operating the control device, since the control signal pressure is generated by the hydraulic selector valve from the pressure of the pilot hydraulic source, the control signal pressure can be provided at a sufficient flow rate; hence the control device can be operated with a better response.

To achieve the above third object, in the above hydraulic circuit system for hydraulic working machine, preferably, the plurality of shuttle valves select a maximum pressure for each of a plurality of predetermined operation signal pressure groups selected from the operation signal pressures generated by the plurality of pilot operating units, the shuttle block produces a plurality of control signal pressures in accordance with the maximum pressures each selected by the shuttle valves for each of the plurality of operation signal pressure groups, and outputs the control signal pressures respectively to a plurality of control devices.

Even in the case of including a plurality of predetermined operation signal pressure groups from each of which the maximum pressure is to be selected, by incorporating all the plurality of shuttle valves in one shuttle block and producing the control signal pressures within the shuttle block to be output from it, the low-pressure system of the shuttle valves is, as mentioned above, perfectly separated from the high-pressure system of the flow control valves. Accordingly, the production cost can be cut down and the circuit configuration can be simplified. As a result, assembling efficiency of the hydraulic circuit system is improved and the control devices can be operated with a good response.

In the above hydraulic circuit system for a hydraulic working machine, preferably, the plurality of actuators include a swing motor for driving an upper swing structure of a hydraulic excavator to swing, the plurality of control devices include a swing brake unit for braking the swing motor, and the shuttle block outputs one of the plurality of control signal pressures to the swing brake unit for switching the swing brake unit to an inoperative position so that the swing brake unit is released from a braked state.

With this feature, in the case of employing the swing brake unit as one of the control devices, the production cost can be cut down and assembling efficiency of the hydraulic circuit system is improved, as mentioned above. In addition, the swing brake unit can be operated with a good response.

In the above hydraulic circuit system for a hydraulic working machine, preferably, at least two hydraulic pumps a provided, the plurality of actuators include left and right track motors for driving a lower track structure of a hydraulic excavator to travel, the plurality of control devices include a track communicating valve capable of shifting between a cutoff position where the left and right track motors are separately connected to the two hydraulic pumps, respectively, and a communicating position where the left and right track motors are connected to one of the two hydraulic pumps in parallel, and the shuttle block outputs one of the plurality of control signal pressures to the track communicating valve for shifting the track communicating valve to the communicating position so that the hydraulic fluid delivered from the one hydraulic pump flows into the left and right track motors.

With this feature, in the case of employing the track communicating valve as one of the control devices, the production cost can be cut down and assembling efficiency of the hydraulic circuit system is improved, as mentioned above. In addition, the track communicating valve can be operated with a good response.

In the above hydraulic circuit system for a hydraulic working machine, preferably, the hydraulic pump is a variable displacement hydraulic pump, the plurality of control devices include a regulator for controlling a capacity of the hydraulic pump, and the shuttle block outputs one of the plurality of control signal pressures to the regulator for operating the regulator to thereby control the capacity of the hydraulic pump.

With this feature, in the case of employing the regulator for the hydraulic pump as one of the control devices, the production cost can be cut down and assembling efficiency of the hydraulic circuit system is improved, as mentioned above. In addition, the regulator can be operated with a good response.

In the above hydraulic circuit system for hydraulic working machine, preferably, the plurality of actuators include left and right track motors for driving a lower track structure of a hydraulic excavator to travel, a boom cylinder, an arm cylinder and a bucket cylinder for driving respectively a boom, an arm and a bucket of the hydraulic excavator, and a swing motor for driving an upper swing structure of the hydraulic excavator to swing with respect to the lower track structure; the plurality of pilot operating units include a right-track operating unit provided with a pair of pilot valves for selectively generating forward and rearward signal pressures for the right track motor, a left-track operating unit provided with a pair of pilot valves for selectively generating forward and rearward signal pressures for the left track motor, a bucket operating unit provided with a pair of pilot valves for selectively generating bucket-crowding and bucket-dumping signal pressures for the bucket cylinder, a boom operating unit provided with a pair of pilot valves for selectively generating boom-raising and boom-lowering signal pressures for the boom cylinder, an arm operating unit provided with a pair of pilot valves for selectively generating arm-crowding and arm-dumping signal pressures for the arm cylinder, and a swing operating unit provided with a pair of pilot valves for selectively generating swing-to-right and swing-to-left signal pressures for the swing motor; and the shuttle block incorporates therein a first shuttle valve for selecting the higher of the signal pressures from the pair of pilot valves of the right-track operating unit, a second shuttle valve for selecting the higher of the signal pressures from the pair of pilot valves of the left-track operating unit, a third shuttle valve for selecting the higher of the signal pressures from the pair of pilot valves of the bucket operating unit, a fourth shuttle valve for selecting the higher of the signal pressures from the pair of pilot valves of the boom operating unit, a fifth shuttle valve for selecting the higher of the signal pressures from the pair of pilot valves of the arm operating unit, a sixth shuttle valve for selecting the higher of the signal pressures from the pair of pilot valves of the swing operating unit, a seventh shuttle valve for selecting the higher of the signal pressures selected by the fourth and fifth shuttle valves, an eighth shuttle valve for selecting the higher of the signal pressures selected by the third and seventh shuttle valves, a ninth shuttle valve for selecting the higher of the signal pressures selected by the seventh and sixth shuttle valves, a tenth shuttle valve for selecting the higher of the signal pressures selected by the first and eighth shuttle valves as one of the maximum pressures of the plurality of operation signal pressure groups, an eleventh shuttle valve for selecting the higher of the signal pressures selected by the second and ninth shuttle valves as another of the maximum pressures of the plurality of operation signal pressure groups, and a twelfth shuttle valve for selecting the higher of the signal pressures selected by the eighth and ninth shuttle valves as still another of the maximum pressures of the plurality of operation signal pressure groups, the shuttle block producing a first pump control signal as one of the plurality of control signal pressures in accordance with the maximum pressure selected by the tenth shuttle valve, a second pump control signal as another of the plurality of control signal pressures in accordance with the maximum pressure selected by the eleventh shuttle valve, and a front/ swing operation signal as still another of the plurality of control signal pressures in accordance with the maximum pressure selected by the twelfth shuttle valve.

In the case of the pilot operating units including the right-track operating unit, the left-track operating unit, the bucket operating unit, the boom operating unit, the arm operating unit, and the swing operating unit, by arranging and connecting the plurality of shuttle valves in a hierarchical structure, the control signal pressure as the first pump control signal, the control signal pressure as the second pump control signal, and the control signal pressure as the front/swing operation signal can be produced from the operation signal pressures generated by those operating units with a minimum number of shuttle valves.

In the above hydraulic circuit system for a hydraulic working machine, preferably, the shuttle block further incorporates therein, as one of the plurality of shuttle valves, a thirteenth shuttle valve for selecting the higher of the signal pressures selected by the first and second shuttle valves as still another of the maximum pressures of the plurality of operation signal pressure groups, and produces a track operation signal as still another of the plurality of control signal pressures in accordance with the maximum pressure selected by the thirteenth shuttle valve.

With this feature, the control signal pressure as the first pump control signal, the control signal pressure as the second pump control signal, and the control signal pressure as the front/swing operation signal can be produced with a minimum number of shuttle valves, as mentioned above. In addition, the track operation signal is also produced as one of the control signal pressures.

To achieve the above fourth object, in the above hydraulic circuit system for a hydraulic working machine, preferably, a reserve port is formed in a block body of the shuttle block, and the shuttle block incorporates therein a reserve shuttle valve for selecting the higher of one of the maximum pressures selected by the plurality of shuttle valves from the predetermined operation signal pressure groups and a pressure at the reserve port.

With such a feature that the reserve port is formed in the block body of the shuttle block and the reserve shuttle valve is provided in the shuttle block, even in the case of providing an additional actuator later in the hydraulic circuit system, the control device can be simply controlled for the additional actuator by connecting a pilot operating unit associated with the additional actuator to the reserve port of the shuttle block.

The above hydraulic circuit system for a hydraulic working machine, preferably, further comprises a reserve flow control valve connected to the hydraulic pump, and a reserve pilot operating unit for converting the pilot pressure of the pilot hydraulic source into a signal pressure.

By providing the reserve flow control valve and the reserve pilot operating unit beforehand, the work required for providing an additional actuator later is more simplified.

To achieve the above fourth object, in the above hydraulic circuit system for a hydraulic working machine, preferably, at least two hydraulic pumps of the variable displacement type are provided, including first and second hydraulic pumps, the plurality of shuttle valves select, of the operation signal pressures generated by the plurality of pilot operating units, a first maximum pressure in a group of those operation signal pressures related to the first hydraulic pump and a second maximum pressure in a group of those operation signal pressures related to the second hydraulic pump, and the control device includes first and second regulators operated by first and second control signal pressures produced in accordance with the first and second maximum pressures selected by the plurality of shuttle valves, respectively, for controlling capacities of the first and second hydraulic pumps; and at least two reserve ports including first and second reserve ports are formed in a block body of the shuttle block, and the shuttle block incorporates therein a first reserve shuttle valve for selecting the higher of a pressure at the first reserve port and the first maximum pressure as the first control signal pressure, and a second reserve shuttle valve for selecting the higher of a pressure at the second reserve port and the second maximum pressure as the second control signal pressure.

With this feature, even in the system including two hydraulic pumps, capacity control of the first and second hydraulic pumps can be simply controlled for an additional actuator by connecting a pilot operating unit associated with the additional actuator to the first and second reserve ports of the shuttle block, respectively.

In the above hydraulic circuit system for a hydraulic working machine, preferably, a plurality of hydraulic pumps are provided, including third and fourth hydraulic pumps; the plurality of actuators include first and second track motors for driving a lower track structure of a hydraulic excavator to travel and at least one front actuator for driving a work front of the hydraulic excavator; the plurality of flow control valves include a first-track flow control valve for supplying a hydraulic fluid delivered from the third hydraulic pump to the first track motor, a front flow control valve for supplying the hydraulic fluid delivered from at least the third hydraulic pump to the front actuator, and a second-track flow control valve for supplying a hydraulic fluid delivered from the fourth hydraulic pump to the second track motor, the first-track flow control valve being so connected that the hydraulic fluid delivered from the third hydraulic pump is supplied to the first track motor with more preference than through the front flow control valve; the plurality of pilot operating units include a first-track pilot operating unit and a front pilot operating unit for operating respectively the first-track flow control valve and the front flow control valve; and the plurality of shuttle valves include a first-track shuttle valve for detecting a first-track maximum pressure of operation signal pressures generated by the first-track pilot operating unit and a front shuttle valve for detecting a front maximum pressure of operation signal pressures generated by the front pilot operating unit; and the system further comprises a communicating line for communicating a hydraulic fluid supply line for the first-track flow control valve and a hydraulic fluid supply line for the second-track flow control valve with each other, a first selector valve capable of opening and closing the communicating line, a check valve disposed in the communicating line for allowing the hydraulic fluid to flow from the side of the first-track flow control valve to the side of the second-track flow control valve, but blocking a reverse flow of the hydraulic fluid, and switching signal output means for generating and outputting a switching signal to shift the first selector valve into the open state when the corresponding maximum pressure signals are both introduced to the switching signal output means through the first-track shuttle valve and the front shuttle valve.

In the combined operation of the front actuator and the first and second track motors, the first-track pilot operating unit and the front pilot operating unit are both manipulated. Of the operation signal pressures generated by those pilot operating units, the first-track maximum pressure and the first front maximum pressure are detected by the first-track shuttle valve and the front shuttle valve, respectively. In accordance with those two maximum pressure signals, the switching signal output means generates and outputs the switching signal to shift the first selector valve into the open state, whereupon the hydraulic fluid supply line for the first-track flow control valve and the hydraulic fluid supply line for the second-track flow control valve are communicated with each other. Because the first-track flow control valve is so connected as to be supplied with the hydraulic fluid from the third hydraulic pump with more preference than the front flow control valve, the hydraulic fluid from the third hydraulic pump is supplied to the first track motor with more preference than to the front actuator. Upon the hydraulic fluid supply lines for the first-track flow control valve and the second-track flow control valve being communicated with each other, therefore, the first and second track flow control valves are so connected as to be supplied with the hydraulic fluid from the third hydraulic pump with more preference than the front flow control valve, and are connected in parallel to the third hydraulic pump. As a result, the hydraulic fluid from the third hydraulic pump is supplied to not only the first-track motor, but also the second-track motor through the communicating line and the check valve with certainty, enabling the lower track structure to travel with good straightforwardness.

On the other hand, when the front actuator and one of the track motors are simultaneously driven to carry out work of dropping mud from the lower track structure of the hydraulic excavator, the system operates as follows. First, when the front actuator and only the first track motor are simultaneously driven, the hydraulic fluid supply lines for the first-track flow control valve and the second-track flow control valve are communicated with each other, as mentioned above. Because of the second track motor being not operated, however, the hydraulic fluid from the third hydraulic pump is supplied to the first-track motor alone. At this time, the hydraulic fluid from the fourth hydraulic pump is blocked from flowing from the side of the second-track motor to the side of the first-track motor by the action of the check valve disposed in the communicating line, and only the hydraulic fluid from the third hydraulic pump is supplied to the first-track motor.

Next, when the front actuator and only the second track motor are simultaneously driven, the front maximum pressure of the operation signal pressures generated by the front pilot operating unit is detected by the first- track shuttle valve, but the first-track operating unit is not manipulated and the first-track maximum pressure is not detected. Therefore, the switching signal output means does not output the switching signal to shift the first selector valve into the open state, and the hydraulic fluid supply lines for the first-track flow control valve and the second-track flow control valve are not communicated with each other. Accordingly, the hydraulic fluid from the third hydraulic pump is supplied to the front actuator through the front flow control valve, but not the second-track motor. Thus, the second-track motor is supplied with only the hydraulic fluid from the fourth hydraulic pump.

In either case, as mentioned above, the hydraulic fluids from the two hydraulic pumps are avoided from being concentrated on one of the track motors, and that track motor is protected from overly rotating.

In the above hydraulic circuit system for a hydraulic working machine, preferably, the switching signal output means includes at least a second selector valve shifted in accordance with the first-track maximum pressure and, as an option, a third selector valve shifted in accordance with the front maximum pressure, at least the second selector valve being built in the one shuttle block.

By incorporating part of the switching signal output means, which also belongs to the low-pressure system, within the shuttle block, the low-pressure system can be perfectly separated from the high-pressure system and the production cost of the entire hydraulic circuit system can be cut down, as mentioned above.

In the above hydraulic circuit system for a hydraulic working machine, preferably, the second selector valve is shifted between a communicating position and a cutoff position in accordance with the first-track maximum pressure, and when held in the communicating position, the second selector valve outputs the front maximum pressure as the switching signal to the first selector valve.

With this feature, the first-track maximum pressure can be used as a drive signal to shift the second selector valve, and the front maximum pressure can be used as the switching signal to shift the first selector valve.

In the above hydraulic circuit system for a hydraulic working machine, preferably, the switching signal output means includes a second selector valve shifted between a communicating position and a cutoff position in accordance with the first-track maximum pressure and a third selector valve shifted between a communicating position and a cutoff position in accordance with the front maximum pressure, the third selector valve establishing a connection to introduce the pilot pressure of the pilot hydraulic source to the second selector valve when held in the communicating position, the second selector valve establishing a connection to output the pilot pressure of the pilot hydraulic source, that is introduced from the third selector valve, as the switching signal to the first selector valve when held in the communicating position, the second and third selector valves being built in the one shuttle block.

By using the first-track maximum pressure as a drive signal to shift the second selector valve and the front maximum pressure as a drive signal to shift the third selector valve, and using the pilot pressure of the pilot hydraulic source as the switching signal to the first selector valve, the valve shift operation can be effected by the switching signal with a better response than the case of using the front maximum pressure as the switching signal.

DESCRIPTION OF THE PREFERRED EMBODIMENTS

Preferred embodiments of the present invention will be described hereunder with reference to the drawings. In the following embodiments, the present invention is applied to a hydraulic excavator as one typical example of a hydraulic working machine.

To begin with, a first embodiment of the present invention will be described with reference to FIGS. 1 to 5.

Figure 1:
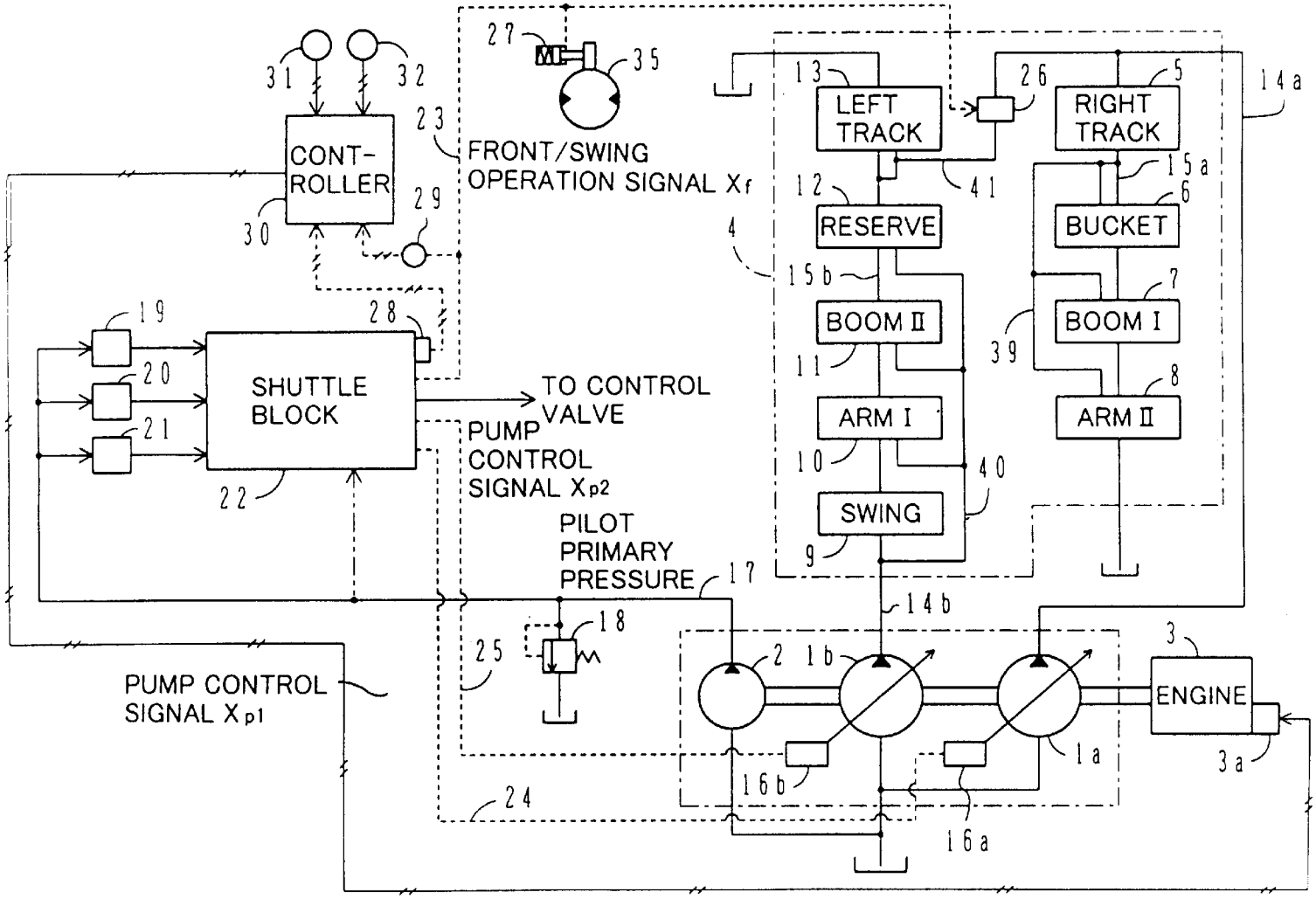
FIG. 1 is a hydraulic circuit diagram showing a hydraulic circuit system for a hydraulic working machine according to a first embodiment of the present invention.

In FIG. 1, a hydraulic circuit system of this first embodiment comprises main hydraulic pumps 1*a*, 1*b*, a pilot pump 2, an engine 3 for driving the pumps 1*a*, 1*b* and 2 for rotation, and a valve unit 4 connected to the main hydraulic pumps 1*a*, 1*b*. The valve unit 4 has two valve groups, i.e., a group of flow control valves 5–8 and a group of flow control valves 9–13. The flow control valves 5–8 are positioned on a center bypass line 15*a* which is connected to a delivery line 14*a* of the main hydraulic pump 1*a*, and the flow control valves 9–13 are positioned on a center bypass line 15*b* which is connected to a delivery line 14*b* of the main hydraulic pump 1*b*.

The main hydraulic pumps 1*a*, 1*b* are variable displacement pumps of swash plate type, and are provided with regulators 16*a*, 16*b* for controlling tiltings of respective swash plates, i.e., pump capacities (displacements).

A pilot relief valve 18 for holding a delivery pressure of the pilot pump 2 at a constant pressure is connected to a delivery line 17 of the pilot pump 2. The pilot pump 2 and the pilot relief valve 18 jointly constitute a pilot hydraulic source.

The flow control valves 5–8 and 9–13 of the valve unit 4 are shifted in accordance with operation signal pressures from pilot operating units 19, 20, 21. The pilot operating units 19, 20, 21 generate respective operation signal pressures based on the delivery pressure (constant pressure) of pilot pump 2 as an original pressure.

Figure 2:
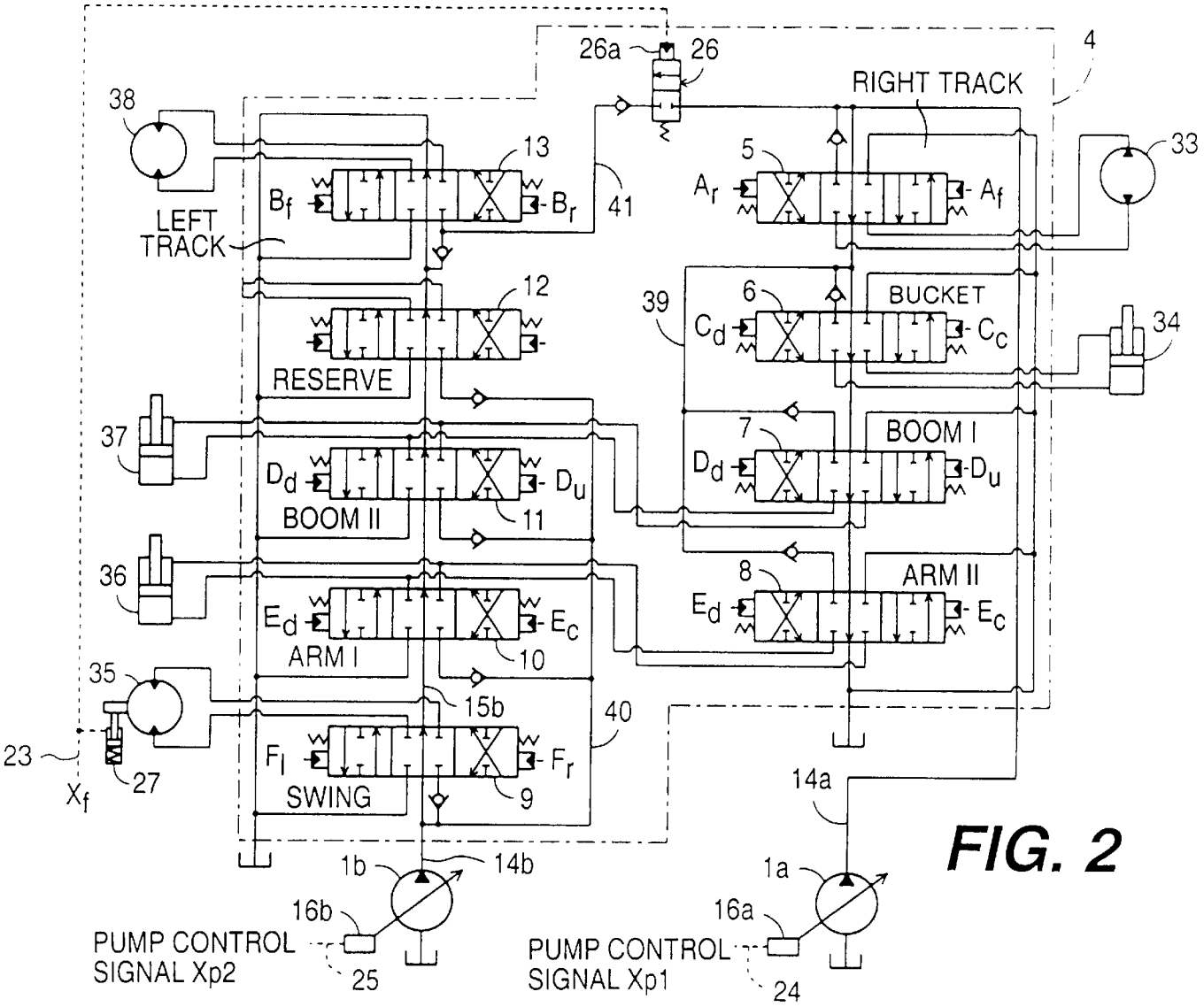
FIG. 2 is a diagram showing details of a valve unit of the hydraulic circuit system shown in FIG. 1.

The operation signal pressures generated by the pilot operating units 19, 20, 21 are once introduced to a shuttle block 22, and then applied to the flow control valves 5–8 and 9–13 through the shuttle block 22 as shown in FIG. 2. In accordance with the operation signal pressures generated by the pilot operating units 19, 20, 21, the shuttle block 22 also creates a front/swing operation signal Xf, a track operation signal Xt (see FIG. 5) and pump control signals Xp1, Xp2. The front/swing operation signal Xf and the pump control signals Xp1, Xp2 are output as control signal pressures to a track communicating valve 26 (described later), a swing brake cylinder 27 (described later) and the pump regulators 16*a*, 16*b* through signal lines 23, 24, 25, respectively.

Further, a pressure sensor 28 for detecting the track operation signal Xt is disposed in the shuttle block 22 and a pressure sensor 29 for detecting the front/swing operation signal Xf is disposed in the signal line 23, signals from these pressure sensors 28, 29 being input to a controller 30. Based on the signals from the pressure sensors 28, 29 and respective signals from an engine revolution speed setting dial 31 and an auto-idling switch 32, the controller 30 creates an engine revolution speed command signal and outputs it to a governor 3*a* of the engine 3 for controlling a revolution speed of the engine 3.

Details of the valve unit 4 are shown in FIG. 2. The flow control valves 5–8 and 9–13 are center bypass valves. Hydraulic fluids delivered from the main hydraulic pumps 1*a*, 1*b* are supplied to corresponding one or more of actuators 33–38 through the flow control valves. The actuator 33 is a hydraulic motor for a right track (right track motor), the actuator 34 is a hydraulic cylinder for a bucket (bucket cylinder), the actuator 35 is a hydraulic motor for swing (swing motor), the actuator 36 is a hydraulic cylinder for arms (arm cylinder), the actuator 37 is a hydraulic cylinder for booms (boom cylinder), and the actuator 38 is a hydraulic motor for a left track (left track motor). The flow control valve 5 is for the right track, the flow control valve 6 is for the bucket, the flow control valve 7 is first boom flow control valve, the flow control valve 8 is second arm flow control valve, the flow control valve 9 is for swing, the flow control valve 10 is first arm flow control valve, the flow control valve 11 is second boom flow control valve, the flow control valve 12 is for reserve, and the flow control valve 13 is for the left track. In other words, the two flow control valves 7, 11 are provided for the boom cylinder 37 and the two flow control valves 8, 10 are provided for the arm cylinder 36 so that the hydraulic fluids from the two hydraulic pumps 1*a*, 1*b* are joined together and supplied to the boom cylinder 37 and the arm cylinder 36.

The flow control valve 5 for the right track is connected in tandem (with preference) upstream of the flow control valves 6–8, and the flow control valves 6, 7, 8 are interconnected in parallel through a bypass line 39. The flow control valves 9–12 are connected in tandem (with preference) upstream of the flow control valve 13 for the left track, and are interconnected in parallel through a bypass line 40.

An input port of the flow control valve 5 for the right track is connected to an input port of the flow control valve 13 for the left track via a communicating line 41, and the aforesaid track communicating valve 26 is disposed in the communicating line 41. The track communicating valve 26 is able to shift between a cutoff position and a communicating position. When the front/swing operation signal Xf (control signal pressure) is not applied from the shuttle block 22 to a pressure receiving sector 26*a*, the track communicating valve 26 is held in the cutoff position, as shown, where the left and right track motors 38, 33 are connected solely to the main hydraulic pumps 1*a*, 1*b*, respectively. When the front/swing operation signal Xf (control signal pressure) is applied to the pressure receiving sector 26*a*, the track communicating valve 26 is shifted to the communicating position where the left and right track motors 38, 33 are connected in parallel to the main hydraulic pump 1*a*.

The aforesaid brake cylinder 27 is provided on an output shaft of the swing motor 35. When the front/swing operation signal Xf (control signal pressure) is not applied from the shuttle block 22, the brake cylinder 27 is held in an operative state to brake the swing motor 35. When the front/swing operation signal Xf (control signal pressure) is applied, the brake cylinder 27 is shifted to an inoperative state to release a brake from the swing motor 35.

Figure 3:
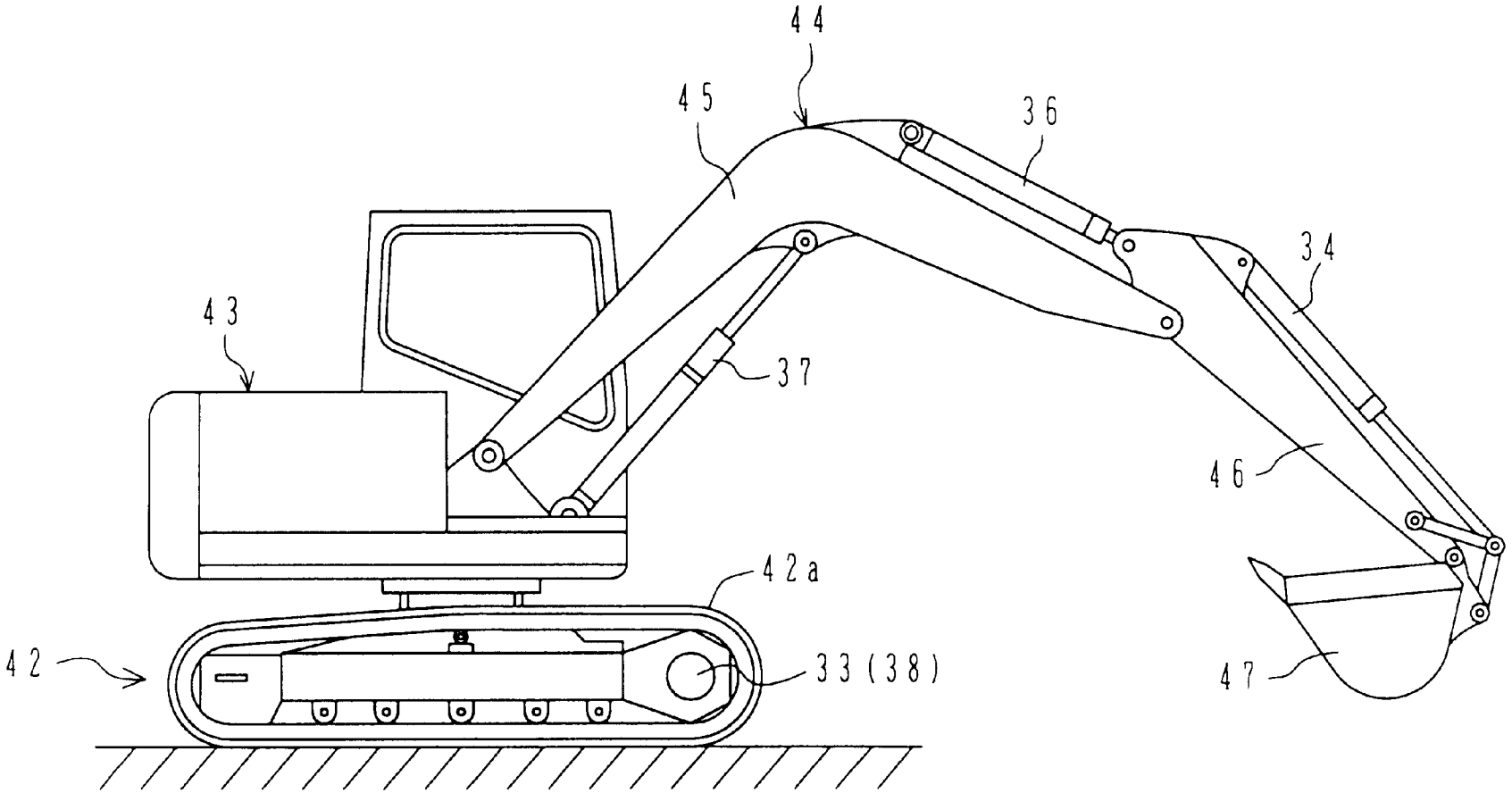
FIG. 3 is a side view showing an appearance of a hydraulic excavator as a typical example of a hydraulic working machine to which the present invention is applied.

FIG. 3 shows an appearance of a hydraulic excavator in which the hydraulic circuit system of the present invention is installed. The hydraulic excavator is made up of a lower track structure 42, an upper swing structure 43, and a work front 44. The left and right track motors 38, 33 are mounted on the lower track structure 42 to drive respective crawlers 42a for rotation, whereupon the excavator travels forward or rearward. The swing motor 35 is mounted on the upper swing structure 43 to swing the upper swing structure 43 with respect to the lower track structure 42. The work front 44 is made up of a boom 45, an arm 46 and a bucket 47. The boom 45 is vertically rotated by the boom cylinder 37, the arm 46 is operated by the arm cylinder 36 to rotate toward the dumping (unfolding) side or the crowding (scooping) side, and the bucket 47 is operated by the bucket cylinder 34 to rotate toward the dumping (unfolding) side or the crowding (scooping) side.

Figure 4:
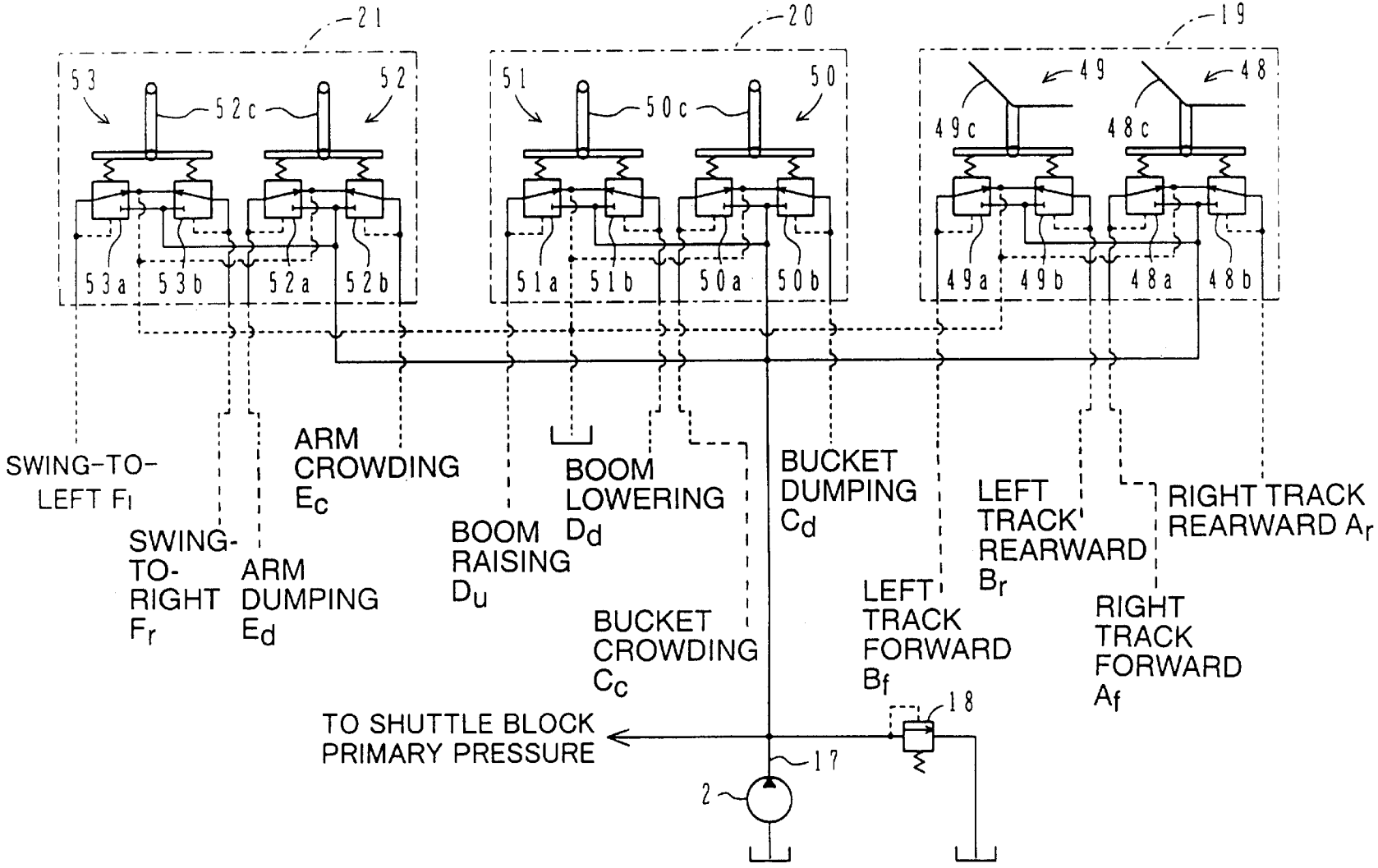
FIG. 4 is a diagram showing details of pilot operating units of the hydraulic circuit system shown in FIG. 1.

Details of the pilot operating units 19, 20, 21 are shown in FIG. 4.

The pilot operating unit 19 consists of a pilot operating unit 48 for the right track and a pilot operating unit 49 for the left track. The pilot operating units 48, 49 comprise respectively pairs of pilot valves (pressure reducing valves) 48*a*, 48*b*; 49*a*, 49*b* and control pedals 48*c*, 49*c*. When the control pedal 48*c* is trod in the back-and-forth direction, one of the pilot valves 48*a*, 48*b* is operated depending on the direction in which the control pedal 48*c* is trod, and an operation signal pressure Af or Ar is generated depending on the input amount by which the control pedal 48*c* is trod. When the control pedal 49*c* is trod in the back-and-forth direction, one of the pilot valves 49*a*, 49*b* is operated depending on the direction in which the control pedal 49*c* is trod, and an operation signal pressure Bf or Br is generated depending on the input amount by which the control pedal 49*c* is trod. The operation signal pressure Af is used for moving the right track forward and the operation signal pressure Ar is used for moving the right track rearward, whereas the operation signal pressure Bf is used for moving the left track forward and the operation signal pressure Br is used for moving the left track rearward.

The pilot operating unit 20 consists of a pilot operating unit 50 for the bucket and a pilot operating unit 51 for the boom. The pilot operating units 50, 51 comprise respectively pairs of pilot valves (pressure reducing valves) 50*a*,50*b*; 51*a*, 51*b* and a common control lever 50*c*. When the control lever 50*c* is manipulated in the left-and-right direction, one of the pilot valves 50*a*,50*b*,is operated depending on the direction in which the control lever 50*c* is manipulated, and an operation signal pressure Cc or Cd is generated depending on the input amount by which the control lever 50*c* is manipulated. When the control lever 50*c* is manipulated in the back-and-forth direction, one of the pilot valves 51*a*, 51*b* is operated depending on the direction in which the control lever 50*c* is manipulated, and an operation signal pressure Du or Dd is generated depending on the input amount by which the control lever 50*c* is manipulated. The operation signal pressure Cc is used for crowding the bucket and the operation signal pressure Cd is used for dumping the bucket, whereas the operation signal pressure Du is used for raising the boom and the operation signal pressure Dd is used for lowering the boom.

The pilot operating unit 21 consists of a pilot operating unit 52 for the arm and a pilot operating unit 53 for swing. The pilot operating units 52, 53 comprise respectively pairs of pilot valves (pressure reducing valves) 52*a*, 52*b*; 53*a*, 53*b* and a common control lever 52*c*. When the control lever 52*c* is manipulated in the left-and-right direction, one of the pilot valves 52*a*, 52*b* is operated depending on the direction in which the control lever 52*c* is manipulated, and an operation signal pressure Ec or Ed is generated depending on the input amount by which the control lever 52*c* is manipulated. When the control lever 52*c* is manipulated in the back-and-forth direction, one of the pilot valves 53*a*, 53*b* is operated depending on the direction in which the control lever 52*c* is manipulated, and an operation signal pressure Fr or Fl is generated depending on the input amount by which the control lever 52*c* is manipulated. The operation signal pressure Ec is used for crowding the arm and the operation signal pressure Ed is used for dumping the arm, whereas the operation signal pressure Fr is used for swinging the upper swing structure to the right and the operation signal pressure Fl is used for swinging it to the left.

Figure 5:
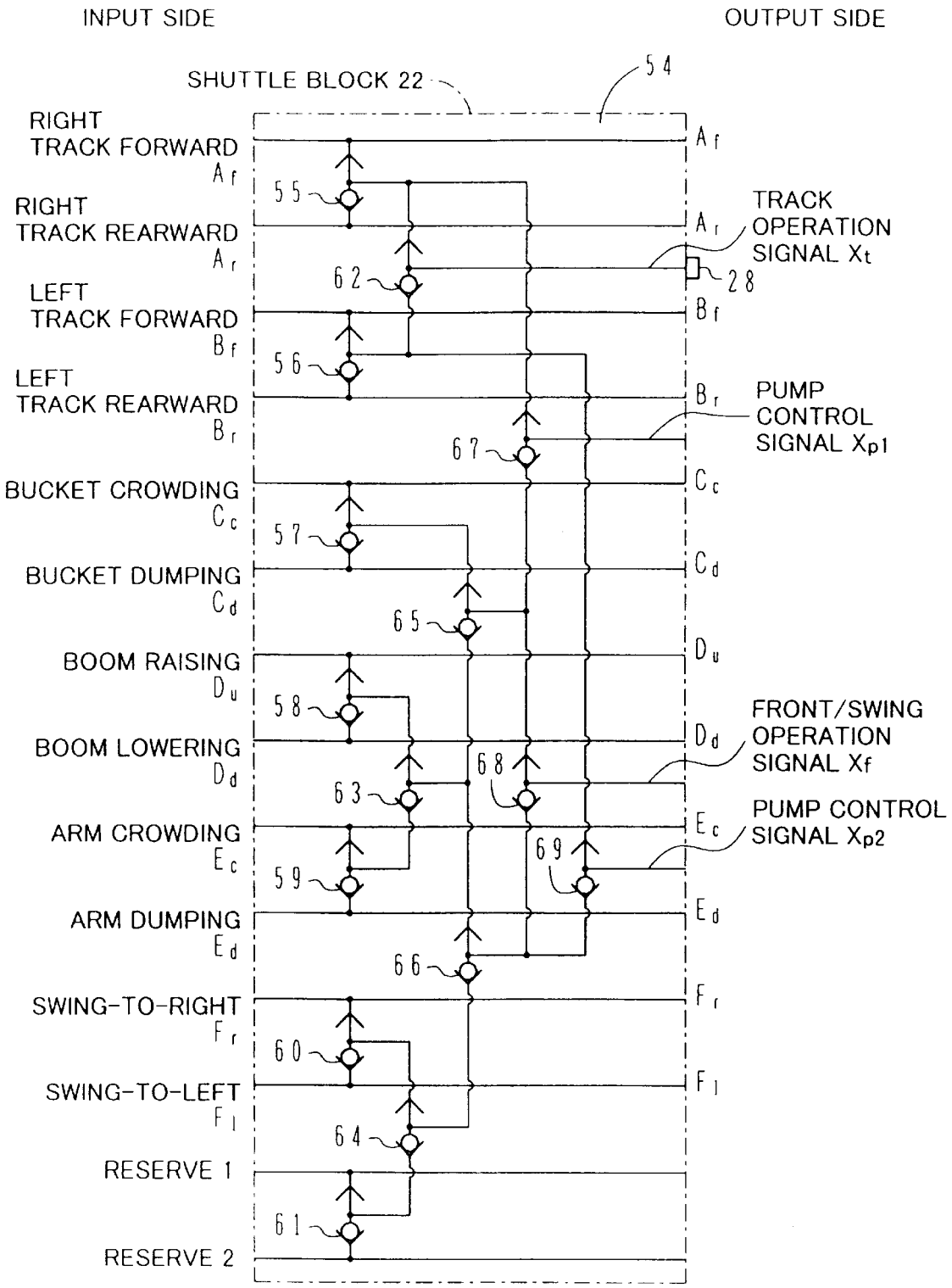
FIG. 5 is a diagram showing details of a shuttle block shown in FIG. 1.

Details of the shuttle block 22 are shown in FIG. 5.

In FIG. 5, the shuttle block 22 comprises a block body 54 and shuttle valves 55–69 which are built in the block body 54.

The shuttle valves 55–61 are disposed in an uppermost (first) upstream stage of a shuttle valve group. The shuttle valve 55 selects the higher of the operation signal pressure Af for moving the right track forward and the operation signal pressure Ar for moving the right track rearward. The shuttle valve 56 selects the higher of the operation signal pressure Bf for moving the left track forward and the operation signal pressure Br for moving the left track rearward. The shuttle valve 57 selects the higher of the operation signal pressure Cc for crowding the bucket and the operation signal pressure Cd for dumping the bucket. The shuttle valve 58 selects the higher of the operation signal pressure Du for raising the boom and the operation signal pressure Dd for lowering the boom. The shuttle valve 59 selects the higher of the operation signal pressure Ec for crowding the arm and the operation signal pressure Ed for dumping the arm. The shuttle valve 60 selects the higher of the operation signal pressure Fr for swinging the upper swing structure to the right and the operation signal pressure Fl for swinging it to the left. The shuttle valve 61 selects the higher of operation signal pressures from a pair of pilot valves of a reserve pilot operating unit which is provided when a reserve actuator is connected to the reserve flow control valve 12.

The shuttle valves 62–64 are disposed in a second stage of the shuttle valve group. The shuttle valve 62 selects the higher of the operation signal pressures selected by the shuttle valves 55, 56 in the first stage. The shuttle valve 63 selects the higher of the operation signal pressures selected by the shuttle valves 58, 59 in the first stage. The shuttle valve 64 selects the higher of the operation signal pressures selected by the shuttle valves 60, 61 in the first stage.

The shuttle valves 65, 66 are disposed in a third stage of the shuttle valve group. The shuttle valve 65 selects the higher of the operation signal pressures selected by the shuttle valve 57 in the first stage and the shuttle valve 63 in the second stage. The shuttle valve 66 selects the higher of the operation signal pressures selected by the shuttle valves 63, 64 in the second stage.

The shuttle valves 67, 68 are disposed in a fourth stage of the shuttle valve group. The shuttle valve 67 selects the higher of the operation signal pressures selected by the shuttle valve 55 in the first stage and the shuttle valve 65 in the third stage. The shuttle valve 68 selects the higher of the operation signal pressures selected by the shuttle valves 65, 66 in the third stage.

The shuttle valve 69 is disposed in a lowermost (fifth) stage of the shuttle valve group and selects the higher of the operation signal pressures selected by the shuttle valve 56 in the first stage and the shuttle valve 66 in the third stage.

The operation signal pressure selected by the shuttle valve 62 is detected as the track operation signal Xt (control signal pressure) by the pressure sensor 28. The operation signal pressure selected by the shuttle valve 68 is output as the front/swing operation signal Xf (control signal pressure) to the track communicating valve 26 and the swing brake cylinder 27, and is also detected by the pressure sensor 29. Further, the operation signal pressure selected by the shuttle valve 67 is output as the pump control signal Xp1 (control signal pressure) to the regulator 16*a* for the main hydraulic pump 1*a*, and the operation signal pressure selected by the shuttle valve 69 is output as the pump control signal Xp2 (control signal pressure) to the regulator 16*b* for the main hydraulic pump 1*b*.

By arranging and connecting the shuttle valves 55–69 in a hierarchical structure from the first stage to the fifth stage as described above, the track operation signal Xt, the front/swing operation signal Xf, and the pump control signals Xp1, Xp2 can be created as control signal pressures from the operation signal pressures generated by the pilot operating unit 48 for the right track, the pilot operating unit 49 for the left track, the pilot operating unit 50 for the bucket, the pilot operating unit 51 for the boom, the pilot operating unit 52 for the arm, and the pilot operating unit 53 for swing with a minimum number of shuttle valves.

In the above construction, the shuttle valve 55 constitutes a first shuttle valve for selecting the higher of signal pressures from a pair of pilot valves of a right-track operating unit. The shuttle valve 56 constitutes a second shuttle valve for selecting the higher of signal pressures from a pair of pilot valves of a left-track operating unit. The shuttle valve 57 constitutes a third shuttle valve for selecting the higher of signal pressures from a pair of pilot valves of a bucket operating unit. The shuttle valve 58 constitutes a fourth shuttle valve for selecting the higher of signal pressures from a pair of pilot valves of a boom operating unit. The shuttle valve 59 constitutes a fifth shuttle valve for selecting the higher of signal pressures from a pair of pilot valves of an arm operating unit. The shuttle valve 60 constitutes a sixth shuttle valve for selecting the higher of signal pressures from a pair of pilot valves of a swing operating unit.

Also, the shuttle valve 63 constitutes a seventh shuttle valve for selecting the higher of the signal pressures selected by the fourth and fifth shuttle valves. The shuttle valve 65 constitutes an eighth shuttle valve for selecting the higher of the signal pressures selected by the third and seventh shuttle valves. The shuttle valve 66 constitutes a ninth shuttle valve for selecting the higher of the signal pressures selected by the seventh and sixth shuttle valves. In addition, the shuttle valve 67 constitutes a tenth shuttle valve for selecting the higher of the signal pressures selected by the first and eighth shuttle valves as one maximum pressure of a plurality of operation signal pressure groups. The shuttle valve 69 constitutes an eleventh shuttle valve for selecting the higher of the signal pressures selected by the second and ninth shuttle valves as another maximum pressure of the plurality of operation signal pressure groups. The shuttle valve 68 constitutes a twelfth shuttle valve for selecting the higher of the signal pressures selected by the eighth and ninth shuttle valves as still another maximum pressure of the plurality of operation signal pressure groups. The shuttle valve 62 constitutes a thirteenth shuttle valve for selecting the higher of the signal pressures selected by the first and second shuttle valves as still another maximum pressure of the plurality of operation signal pressure groups.

Further, the operation signal pressures Af, Ar, Bf, Br, Cd, Cc, Dd, Du, Ec, Ed, Fr and Fl from the pilot operating units 48, 49, 50, 51, 52 and 53 constitute operation signal pressures generated by a plurality of pilot operating units. Of the operation signal pressures, for example, those ones Af, Ar, Cc, Cd, Du, Dd, Ec and Ed constitute one predetermined group of operation signal pressures, and the pump control signal Xp1 being a maximum pressure in that group constitutes a first pump control signal as one control signal pressure. Likewise, the operation signal pressures Bf, Br, Du, Dd, Ec, Ed, Fr and Fl constitute one predetermined group of operation signal pressures, and the pump control signal Xp2 being a maximum pressure in that group constitutes one control signal pressure. The operation signal pressures Cc, Cd, Du, Dd, Ec, Ed, Fr and Fl constitute one predetermined group of operation signal pressures, and the front/swing operation signal Xf being a maximum pressure in that group constitutes a second pump control signal as one control signal pressure. Also, the operation signal pressures Af, Ar, Bf and Br constitute one predetermined group of operation signal pressures, and the track operation signal Xt being a maximum pressure in that group constitutes one control signal pressure.

In this embodiment thus constructed, when at least one of the pilot operating unit 48 for the right track, the pilot operating unit 50 for the bucket, the pilot operating unit 51 for the boom, and the pilot operating unit 52 for the arm is manipulated, one ore more generated operation signal pressure are applied to the corresponding one or more of the flow control valves 5–8. In the case of the number of the generated operation signal pressures being one, that operation signal pressure is output as the pump control signal Xp1 to the regulator 16*a* for the main hydraulic pump 1*a*. In the case of the number of the generated operation signal pressures being plural, the maximum of the plurality of operation signal pressures is selected by the shuttle valves 55, 57, 58, 59, 63, 65 and 67, and then output as the pump control signal Xp1 to the regulator 16*a* for the main hydraulic pump 1*a*. The regulator 16*a* has such a characteristic that the tilting of the main hydraulic pump 1*a* is increased as the pressure of the pump control signal Xp1 rises. Upon the pump control signal Xp1 being applied, the regulator 16*a* increases the delivery rate of the main hydraulic pump 1*a* depending on the pressure of the pump control signal Xp1. As a result, one or more of the flow control valves corresponding to the generated operation signal pressures are shifted, and the hydraulic fluid is delivered from the main hydraulic pump 1*a* at a flow rate depending on the one or selected operation signal pressure (the input amount of the pilot operating unit). The delivered hydraulic fluid is supplied to the corresponding one or more of the actuators 33, 34, 36 and 37 for driving them.

When at least one of the pilot operating unit 49 for the left track, the pilot operating unit 51 for the boom, the pilot operating unit 52 for the arm, and the pilot operating unit 53 for swing is manipulated, one or more generated operation signal pressures are applied to the corresponding one or more of the flow control valves 9, 10, 11 and 13. In the case of the number of the generated operation signal pressures being one, that operation signal pressure is output as the pump control signal Xp2 to the regulator 16*b* for the main hydraulic pump 1*b*. In the case of the number of the generated operation signal pressures being plural, the maximum of the plurality of operation signal pressures is selected by the shuttle valves 56, 58, 59, 60, 63, 64, 66 and 69, and then output as the pump control signal Xp2 to the regulator 16*b* for the main hydraulic pump 1*b*. The regulator 16*b* also has such a characteristic that the tilting of the main hydraulic pump 1*b* is increased as the pressure of the pump control signal Xp2 rises. Upon the pump control signal Xp2 being applied, the regulator 16*b* increases the delivery rate of the main hydraulic pump 1*b* depending on the pressure of the pump control signal Xp2. As a result, one or more of the flow control valves corresponding to the generated operation signal pressures are shifted, and the hydraulic fluid is delivered from the main hydraulic pump 1*b* at a flow rate depending on the one or selected operation signal pressure (the input amount of the pilot operating unit). The delivered hydraulic fluid is supplied to the corresponding one or more of the actuators 35, 36, 37 and 38 for driving them.

When at least one of the pilot operating unit 50 for the bucket, the pilot operating unit 51 for the boom, the pilot operating unit 52 for the arm, and the pilot operating unit 53 for swing is manipulated, one or more generated operation signal pressures are applied to the corresponding one or more of the flow control valves 6, 7, 8, 9, 10 and 11. In the case of the number of the generated operation signal pressures being one, that operation signal pressure is output as the front/swing operation signal Xf to the swing brake cylinder 27. In the case of the number of the generated operation signal pressures being plural, the maximum of the plurality of operation signal pressures is selected by the shuttle valves 57, 58, 59, 60, 63, 64, 65, 66 and 68, and then output as the front/swing operation signal Xf to the swing brake cylinder 27. Accordingly, corresponding one or more of the actuators 34, 35, 36, 37 are driven and the brake cylinder 27 is released from a braked state. As a result, when the pilot operating unit 53 for swing is manipulated, the swing motor 35 is allowed to rotate. Also, when any of the pilot operating unit 50 for the bucket, the pilot operating unit 51 for the boom, and the pilot operating unit 52 for the arm is manipulated, a gear reducer (not shown) provided between the swing motor 35 and a swing link is prevented from being subject to a load because of the swing motor 35 being released from a braked state, even when swing forces act on the upper swing structure due to reaction forces caused upon operation of the work front 44.

When at least one of the pilot operating unit 50 for the bucket, the pilot operating unit 51 for the boom, the pilot operating unit 52 for the arm, and the pilot operating unit 53 for swing is manipulated with intent to carry out the combined operation of track/front or track/swing under a condition where the pilot operating unit 48 for the right track and the pilot operating unit 49 for the left track, generated operation signal pressures are applied to the flow control valves 5, 13 and corresponding one or more of the flow control valves 6, 7, 8, 9, 10 and 11. The maximum of the operation signal pressures from the pilot operating unit 50 for the bucket, the pilot operating unit 51 for the boom, the pilot operating unit 52 for the arm, and the pilot operating unit 53 for swing is selected by the shuttle valves 57, 58, 59, 60, 63, 64, 65, 66 and 68, and then output as the front/swing operation signal Xf to the track communicating valve 26. Accordingly, the track communicating valve 26 is shifted from the shown cutoff position to the communicating position, allowing the hydraulic fluid delivered from the main hydraulic pump 1*a* to flow into not only the flow control valve 5, but also the flow control valve 13. As a result, even when one or more of the flow control valves 9, 10, 11 upstream of the flow control valve 13 is shifted and the hydraulic fluid delivered from the main hydraulic pump 1*b* to the shifted flow control valves with preference, the hydraulic fluid delivered from the main hydraulic pump 1*a* can be supplied to both the track motors 33, 38. The main hydraulic pump 1*a* can be thereby used for travel (track operation) only during the combined operation of track/front or track/swing.

Further, when at least one of all the pilot operating units (the pilot operating unit 48 for the right track, the pilot operating unit 49 for the left track, the pilot operating unit 50 for the bucket, the pilot operating unit 51 for the boom, the pilot operating unit 52 for the arm, and the pilot operating unit 53 for swing) is manipulated, one or more generated operation signal pressures are applied to the corresponding one or more of the flow control valves 5–11 and 13. In addition, when at least one of the pilot operating unit 48 for the right track and the pilot operating unit 49 for the left track is manipulated, the maximum of the generated operation signal pressures is selected by the shuttle valves 55, 56 and 62 and detected as the track operation signal Xt by the pressure sensor 28. Also, when at least one of the pilot operating unit 50 for the bucket, the pilot operating unit 51 for the boom, the pilot operating unit 52 for the arm, and the pilot operating unit 53 for swing is manipulated, the maximum of the generated operation signal pressures is output as the front/swing operation signal Xf, as described above, and detected by the pressure sensor 29. The signals from the pressure sensors 28, 29 are applied to the controller 30.

When the auto-idling switch 32 is turned off, the controller 30 creates an engine revolution speed command signal based on the signal from the engine revolution speed setting dial 31, and outputs it to the governor 3*a* of the engine 3 for controlling the engine 3 to have a target revolution speed set by the engine revolution speed setting dial 31. When the track operation signal Xt or the front/swing operation signal Xf is detected by the pressure sensor 28 or 29 in a condition where the auto-idling switch 32 is turned on, the controller 30 controls the engine 3 to have a target revolution speed set by the engine revolution speed setting dial 31 as with the case of the auto-idling switch 32 being turned off. On the other hand, when neither the track operation signal Xt nor the front/swing operation signal Xf is detected by the pressure sensors 28, 29 in a condition where the auto-idling switch 32 is turned on, i.e., when any pilot operating units are manipulated, the controller 30 outputs, as the engine revolution speed command signal, an idling command signal regardless of the setting of the engine revolution speed setting dial 31, and thereby control the revolution speed of the engine 3 to become a predetermined low revolution speed. As a result, in a neutral state where any actuators are not operated, the revolution speed of the engine 3 is automatically reduced to the predetermined low revolution speed and therefore economical operation is achieved.

With this embodiment, as described above, control devices such as the regulators 16*a*, 16*b* for the main hydraulic pumps 1*a*, 1*b*, the swing brake cylinder 27, the track communicating valve 26, and the governor 3*a* of the engine 3 can be operated by creating required control signal pressures from the operation signal pressures within the shuttle block 22.

Also, with this embodiment, since the shuttle valves 55–69 are built in the shuttle block 22 and the required control signal pressures are created within the shuttle block 22, a low-pressure system (pilot system) of the shuttle valves is perfectly separated from a high-pressure system of the flow control valves 5–13 and the valve block of the valve unit 4, which is made of a high-strength material, can have a small size. On the other hand, the block body 54 of the shuttle block 22, which serves as a common valve block of the shuttle valves 55–69, can be made of an inexpensive material. As a result, the overall production cost can be cut down.

Further, since the shuttle valves 55–69 are all built in one shuttle block 22, piping lines between the shuttle valves are no longer required and therefore the circuit configuration is simplified. Accordingly, assembling efficiency of the hydraulic circuit system is improved and a pressure loss during the transmission of the signal pressures is minimized, resulting in that the control devices such as the regulators 16*a*, 16*b*, the swing brake cylinder 27, the track communicating valve 26, and the engine governor 3*a* can be operated with a good response.

Moreover, with this embodiment, since the shuttle valves 55–69 are arranged and connected within the shuttle block 22 in a hierarchical structure from the first stage to the fifth stage, the track operation signal Xt, the front/swing operation signal Xf, and the pump control signals Xp1, Xp2 can be created as control signal pressures from the operation signal pressures generated by the pilot operating unit 48 for the right track, the pilot operating unit 49 for the left track, the pilot operating unit 50 for the bucket, the pilot operating unit 51 for the boom, the pilot operating unit 52 for the arm, and the pilot operating unit 53 for swing with a minimum number of shuttle valves. Consequently, the shuttle block 22 can be made compact and the production cost can be reduced.

Figure 6:
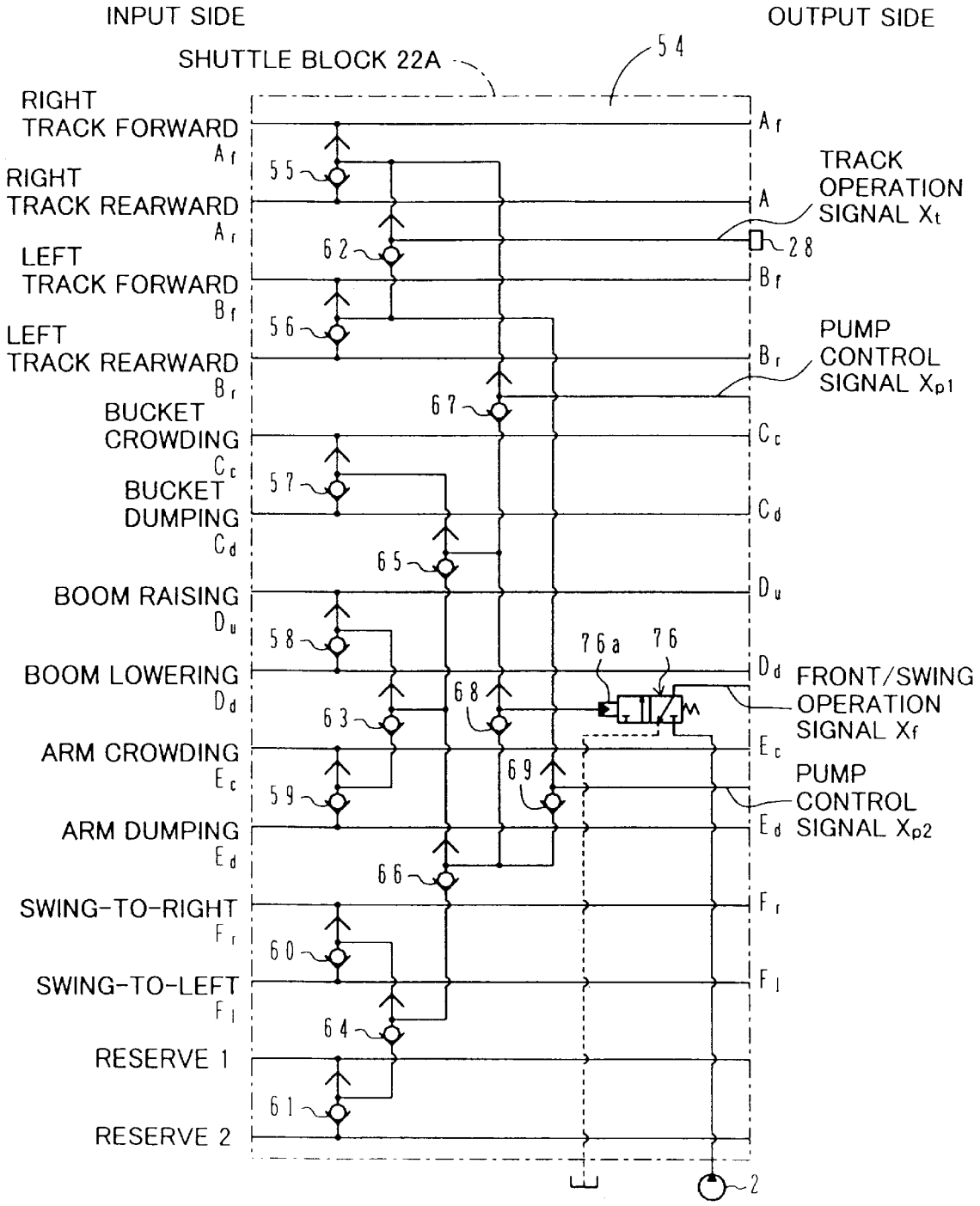
FIG. 6 is a diagram showing details of a shuttle block in a hydraulic circuit system for a hydraulic working machine according to a second embodiment of the present invention.

A second embodiment of the present invention will be described below with reference to FIG. 6. In FIG. 6, equivalent members to those shown in FIG. 5 are denoted by the same reference numerals. In this second embodiment, part of the required control signal pressures is created by a hydraulic selector valve within a shuttle block.

More specifically, in FIG. 6, a shuttle block 22A includes a hydraulic selector valve 76 in addition to shuttle valves 55–69 built in a block body 54. The shuttle valves 55–69 are the same as those in the above first embodiment.

The hydraulic selector valve 76 has a pressure receiving sector 76*a* to which the maximum pressure selected by the shuttle valve 68 is introduced, and is operated in accordance with that maximum pressure to generate a control signal pressure from the pressure of the pilot pump 2. When the maximum pressure selected by the shuttle valve 68 is a reservoir pressure, the hydraulic selector valve 76 is held in a position, as shown, where the control signal pressure is reduced down to the reservoir pressure. When the maximum pressure selected by the shuttle valve 68 exceeds the reservoir pressure, the hydraulic selector valve 76 is shifted from the shown position to an opposite position where the pressure of the pilot pump 2, that is introduced to the shuttle block 22A (see a two-dot-chain line in FIG. 1), is output as the control signal pressure (the front/swing operation signal Xf). The swing brake cylinder 27 and the track communicating valve 26 are operated by the output control signal pressure.

In this embodiment thus constructed, since the operation signal pressure selected as the maximum pressure by the shuttle valve 68 is utilized just in a limited passage within the shuttle block 22A for being used for the swing brake cylinder 27 and the track communicating valve 26 which are control devices, the length of a transmission line of the operation signal pressure selected as the maximum pressure by the shuttle valve 68 is not so increased and therefore one or more corresponding flow control valves can be shifted with a good response. On the other hand, from the point of operating the swing brake cylinder 27 and the track communicating valve 26 which are control devices, since the control signal pressure (the front/swing operation signal Xf) is generated by the hydraulic selector valve 76 from the pressure of the pilot hydraulic source 2, 18, the control signal pressure can be provided at a sufficient flow rate; hence the swing brake cylinder 27 and the track communicating valve 26 can be operated with a better response.

Accordingly, in addition to the similar advantages as obtainable with the above first embodiment, this second embodiment can provide an advantage of enabling the swing brake cylinder 27 and the track communicating valve 26 to be shifted with a better response. Specifically, for the swing brake cylinder 27, the speed of releasing a swing brake is increased and the brake can be reliably released prior to the start-up of the swing motor 35, etc. For the track communicating valve 26, it is reliably shifted to the communicating position before starting to travel, resulting in that the excavator can travel with improved straightforwardness. Further, since the flow control valves can also be shifted with a good response, smooth operability can be achieved in the entirety of hydraulic control system.

Figure 7:
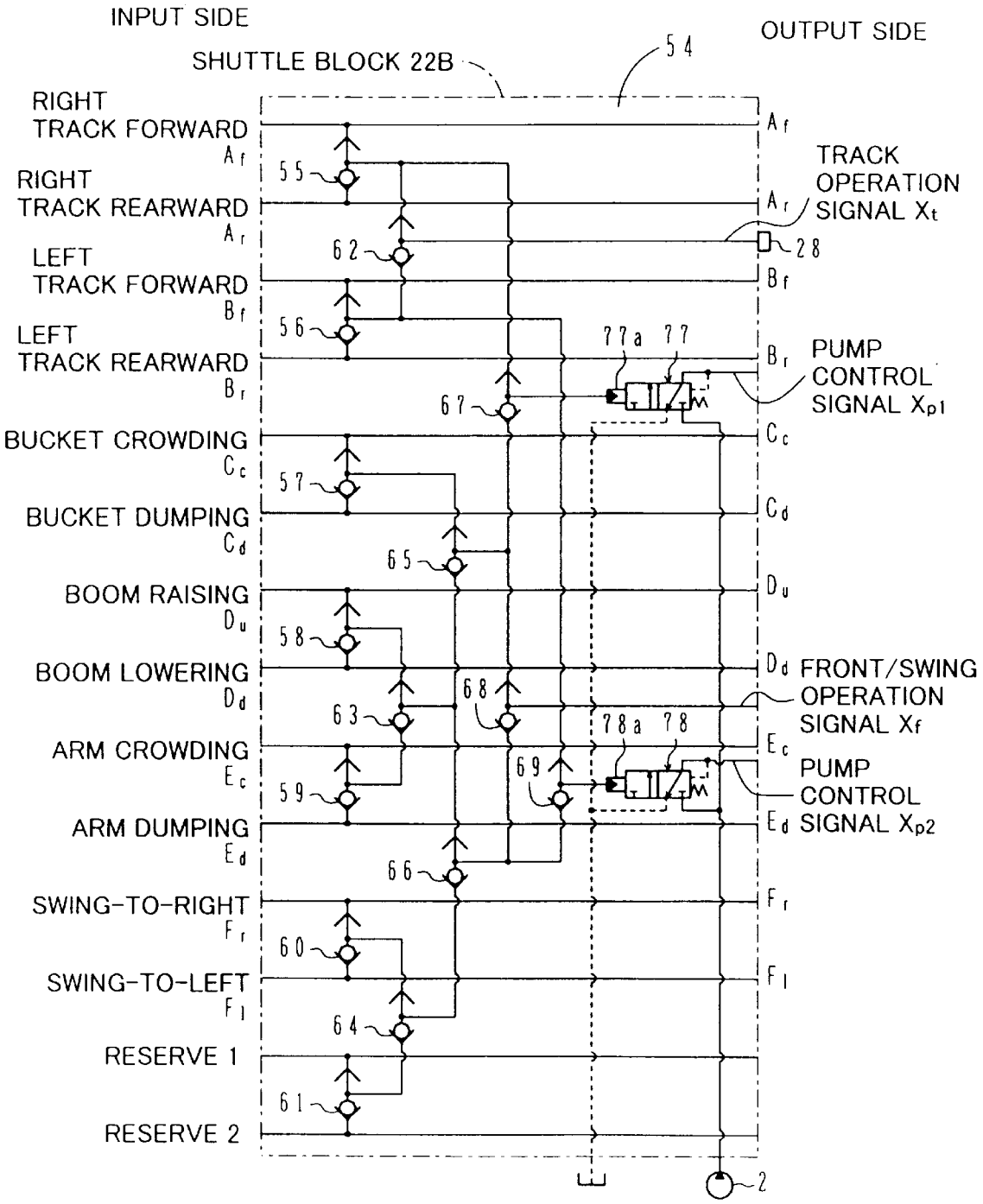
FIG. 7 is a diagram showing details of a shuttle block in a hydraulic circuit system for a hydraulic working machine according to a third embodiment of the present invention.

A third embodiment of the present invention will be described below with reference to FIG. 7. In FIG. 7, equivalent members to those shown in FIG. 5 are denoted by the same reference numerals. In this third embodiment, too, part of the required control signal pressures is created by a hydraulic selector valve within a shuttle block.

More specifically, in FIG. 7, a shuttle block 22B includes hydraulic selector valves 77, 78 in addition to shuttle valves 55–69 built in a block body 54. The shuttle valves 55–69 are the same as those in the above first embodiment.

The hydraulic selector valve 77 is a proportional pressure reducing valve having a pressure receiving sector 77a to which the maximum pressure selected by the shuttle valve 67 is introduced, and being operated in accordance with the maximum pressure to generate a control signal pressure from the pressure of the pilot pump 2. The hydraulic selector valve 77 is operated depending on a level of the maximum pressure selected by the shuttle valve 67, and reduces the pressure of the pilot pump 2 down to a control signal pressure corresponding to the level of the above maximum pressure, followed by outputting it as the pump control signal Xp1. The regulator 16*a* for the main hydraulic pump 1*a* is operated by the output control signal pressure.

The hydraulic selector valve 78 is a proportional pressure reducing valve having a pressure receiving sector 78*a* to which the maximum pressure selected by the shuttle valve 69 is introduced, and being operated in accordance with the maximum pressure to generate a control signal pressure from the pressure of the pilot pump 2. The hydraulic selector valve 78 is operated depending on a level of the maximum pressure selected by the shuttle valve 69, and reduces the pressure of the pilot pump 2 down to a control signal pressure corresponding to the level of the above maximum pressure, followed by outputting it as the pump control signal Xp2. The regulator 16*b* for the main hydraulic pump 1*b* is operated by the output control signal pressure.

Also in this embodiment thus constructed, since the operation signal pressures selected as the maximum pressures by the shuttle valves 67, 69 are utilized just in limited passages within the shuttle block 22B for being used for the regulators 16*a*, 16*b* which are control devices, the length of a transmission line of each of the operation signal pressures selected as the maximum pressures by the shuttle valves 67, 69 is not so increased and therefore one or more corresponding flow control valves can be shifted with a good response. On the other hand, from the point of operating the regulators 16*a*, 16*b* which are control devices, since the control signal pressures (the pump control signals Xp1, Xp2) are generated by the hydraulic selector valves 77, 78 from the pressure of the pilot hydraulic source, the control signal pressures can be each provided at a sufficient flow rate; hence the regulators 16*a*, 16*b* can be operated with a better response.

Accordingly, in addition to the similar advantages as obtainable with the above first embodiment, this third embodiment can provide an advantage of enabling the regulators 16*a*, 16*b* to be operated with a better response. Therefore, the delivery rates of the main hydraulic pumps 1*a*, 1*b* can be quickly increased and decreased upon the pilot operating unit being manipulated. Further, since the flow control valves can also be shifted with a good response, smooth operability can be achieved in the entirety of hydraulic control system.

Figure 8:
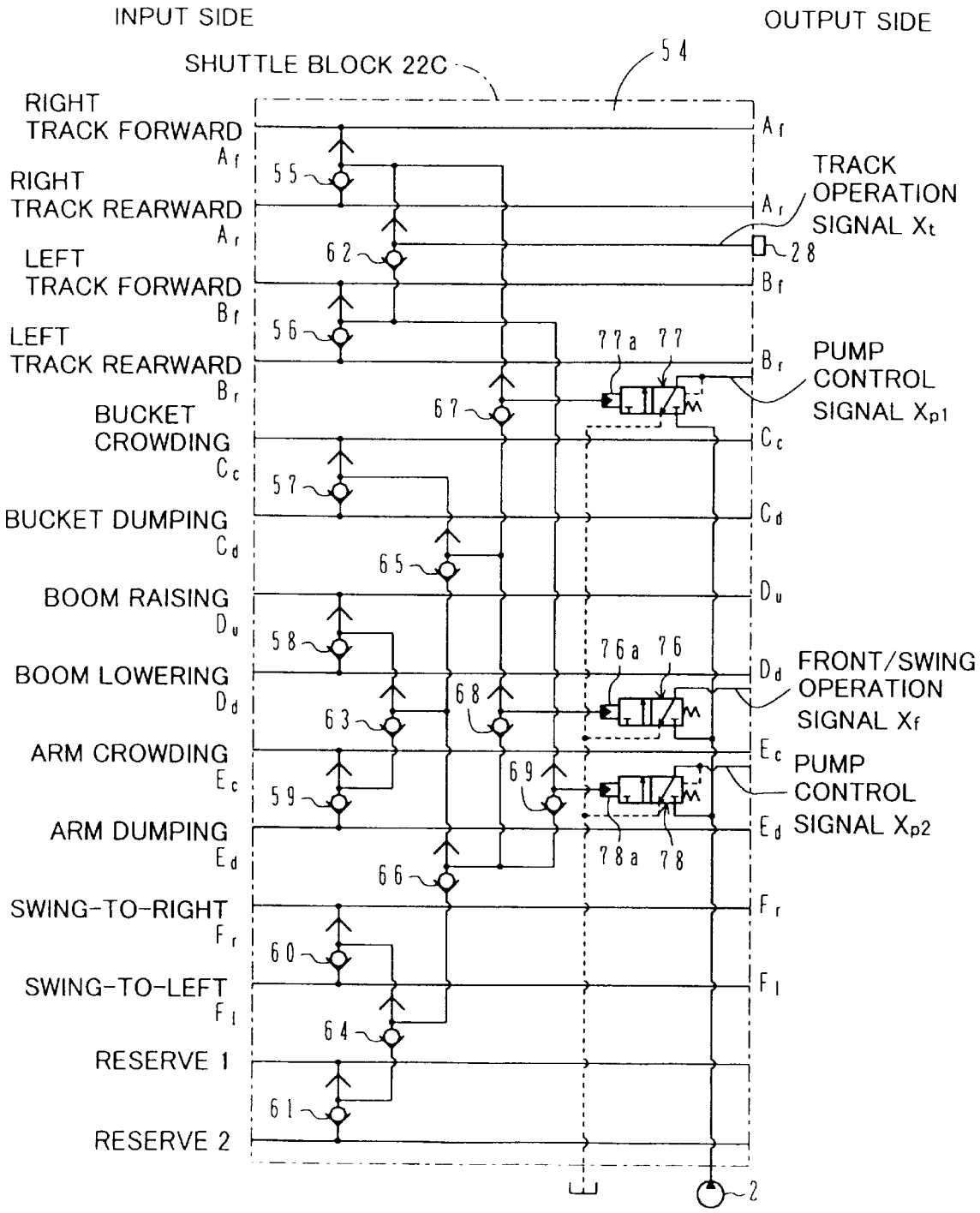
FIG. 8 is a diagram showing details of a shuttle block in a hydraulic circuit system for hydraulic working a machine according to a fourth embodiment of the present invention.

A fourth embodiment of the present invention will be described below with reference to FIG. 8. In FIG. 8, equivalent members to those shown in FIGS. 5–7 are denoted by the same reference numerals. In this fourth embodiment, the above second and third embodiments are combined with each other.

More specifically, in FIG. 8, a shuttle block 22C includes hydraulic selector valves 76, 77, 78 in addition to shuttle valves 55–69 built in a block body 54. The shuttle valves 55–69 are the same as those in the first embodiment, the hydraulic selector valve 76 is the same as that in the second embodiment, and the hydraulic selector valves 77, 78 are the same as those in the third embodiment.

With this fourth embodiment, the advantages of the first, second and third embodiments can be all obtained.

Note that while the control devices have been described in the above first to fourth embodiments as being a swing brake cylinder, a track communicating valve, pump regulators and an engine governor, the present invention can also be likewise applied to other control devices while providing the similar advantages.

A fifth embodiment of the present invention will be described below with reference to FIGS. 9–11. In this fifth embodiment, a reserve port is formed in a shuttle block.

Figure 9:
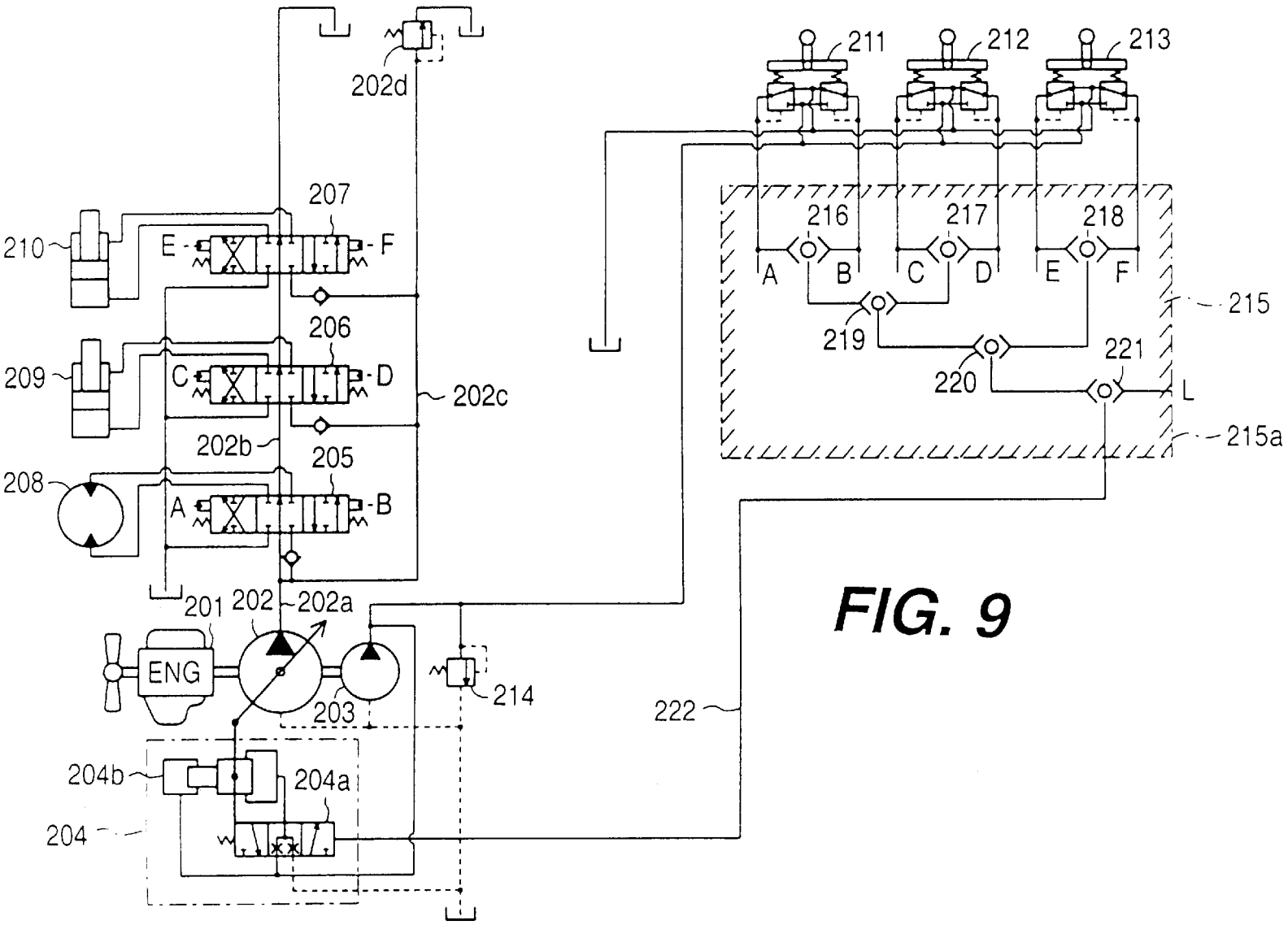
FIG. 9 is a hydraulic circuit diagram showing a hydraulic circuit system for a hydraulic working machine according to a fifth embodiment of the present invention.
Figure 10:
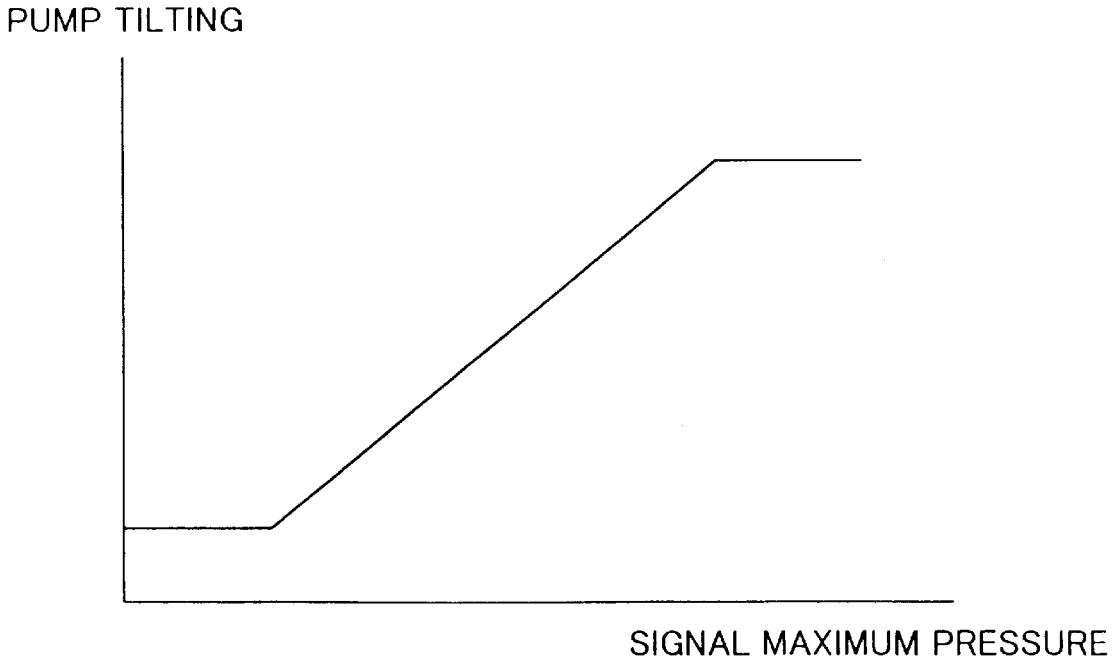
FIG. 10 is a graph showing the relationship between a signal maximum pressure and a pump tilting in a regulator for tilting control of a hydraulic pump.

In FIG. 9, a hydraulic pump 202 as a main pump and a pilot pump 203 are driven by an engine 201 for rotation. The hydraulic pump 202 is a variable displacement pump whose tilting is controlled by a regulator 204 to control a pump delivery capacity.

A hydraulic fluid delivered from the hydraulic pump 202 is supplied to and returned from actuators, i.e., a hydraulic motor 208 and hydraulic cylinders 209, 210, through shifting of flow control valves 205, 206, 207. Here, the flow control valves 205, 206, 207 are of the center bypass type. A center bypass line 202*b* is connected at its upstream end to a delivery line 202*a* of the hydraulic pump 202 and at its downstream end to a reservoir. Respective center bypass ports of the flow control valves 205, 206, 207 are connected in series to the center bypass line 202*b*. A hydraulic fluid supply line 202*c* is also connected to the delivery line 202*a* of the hydraulic pump 202, and respective pump ports of the flow control valves 205, 206, 207 are connected in parallel to the hydraulic fluid supply line 202*c*. The hydraulic fluid supply line 202*c* is connected at its downstream end to the reservoir through a relief valve 202*d* which serves as a safety valve.

Pilot operating units 211, 212, 213 are provided respectively for the actuators 208, 209, 210. The pilot operating units 211, 212, 213 comprise respective pairs of pilot valves (pressure reducing valves) which convert a pilot pressure of the pilot pump 203 into signal pressures A or B, C or D and E or F depending on the direction and input amount in and by which associated control levers are manipulated. The signal pressures are introduced to hydraulic driving sectors at opposite ends of the flow control valves 205, 206, 207 for shifting these valves. The pilot pressure of the pilot pump 203 is set by a pilot pressure relief valve 214.

A shuttle block 215, which constitutes a feature of this embodiment, comprises a block body 215*a* and a plurality of shuttle valves 216, 217, 218, 219, 220 and 221 built in the block body 215*a*. The maximum of signal pressures from the pilot operating units 211, 212, 213 is detected by the shuttle valves 216, 217, 218, 219 and 220, and the detected maximum pressure is transmitted to the regulator 204 for the hydraulic pump 202 through the shuttle valve 221 and a line 222.

The regulator 204 comprises a control valve 204*a* and a servo piston 204*b*. The maximum pressure selected in the shuttle block 215 is introduced to the control valve 204*a*. As the maximum pressure introduced to the control valve 204*a* rises, the control valve 204*a* is shifted to the left on the drawing, whereupon the pilot pressure of the pilot pump 203 is introduced to a larger-diameter pressure receiving chamber of the servo piston 204*b*, causing the servo piston 204*b* to move to the left on the drawing because of a difference between sectional areas of the smaller- and larger-diameter pressure receiving chambers. As a result, the tilting, i.e., delivery capacity, of the hydraulic pump 202 is increased. When the maximum pressure introduced to the control valve 204*a* lowers, the control valve 204*a* is shifted to the right on the drawing, whereupon the reservoir pressure is introduced to the larger-diameter pressure receiving chamber of the servo piston 204*b* to reduce the pressure in it, causing the servo piston 204*b* to move to the right on the drawing. As a result, the tilting, i.e., delivery capacity, of the hydraulic pump 202 is decreased. Thus, the variable displacement hydraulic pump 202 is controlled by the regulator 204 to have a characteristic shown in FIG. 10 in accordance with the maximum pressure selected in the shuttle block 215.

In the shuttle block 215, the shuttle valve 221 is provided for reserve to be used when an actuator is added, and a reserve port L is formed in the block body 215*a* corresponding to the shuttle valve 221. The higher of the pressure at the reserve port L and the output pressure of the shuttle valve 220 is selectively detected by the reserve shuttle valve 221.

In the above construction, the operation signal pressures A, B, C, D, E and F from the pilot operating units 211, 212, 213 constitute operation signal pressures generated by a plurality of pilot operating units, and all of the operation signal pressures constitute one predetermined group of operation signal pressures. Then, the shuttle valve 221 constitutes a reserve shuttle valve for selecting the higher of the maximum pressure in that group (i.e., the pressure selected by the shuttle valve 220) and the pressure at the reserve port L.

Figure 11:
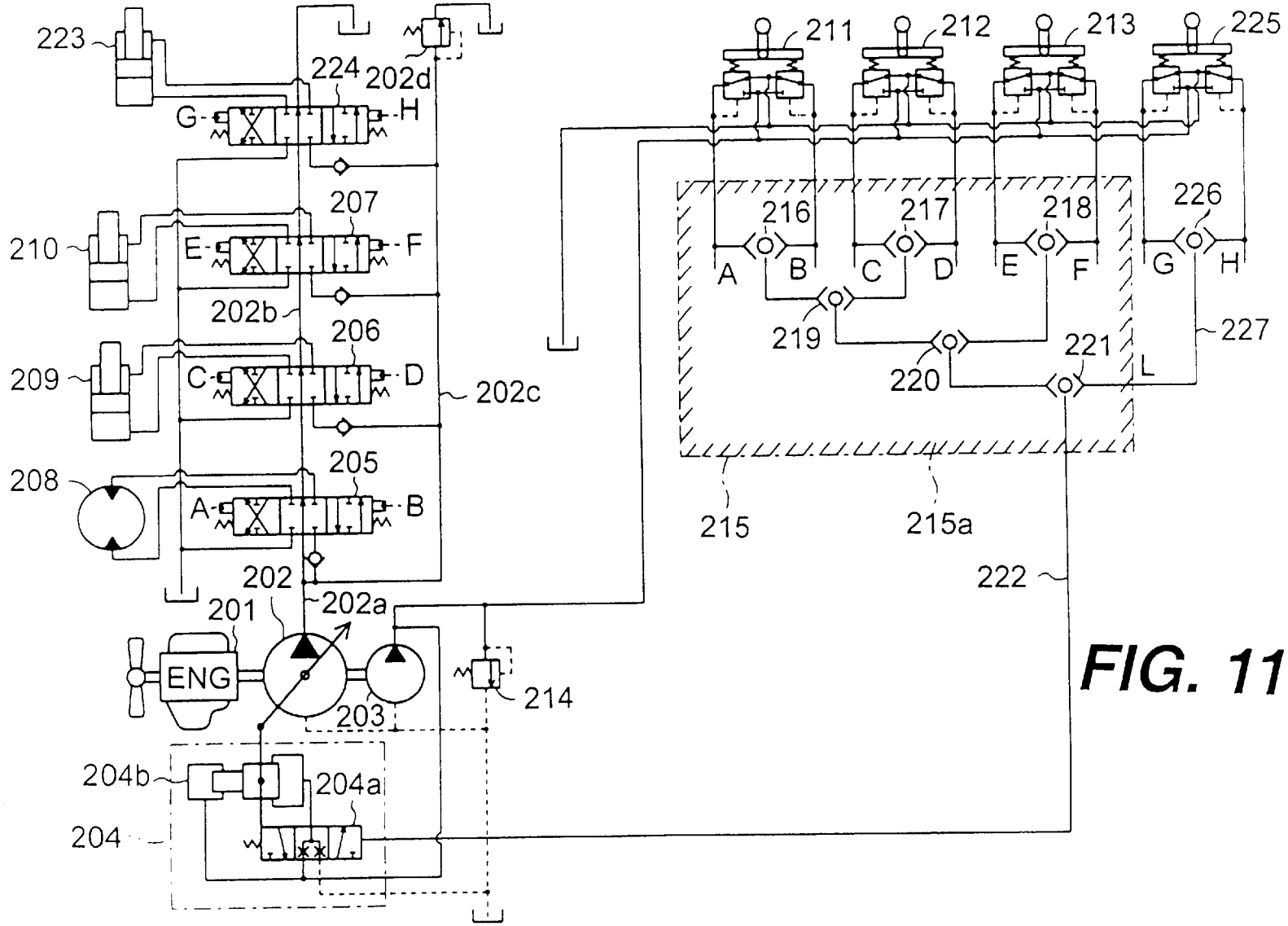
FIG. 11 is a hydraulic circuit diagram showing a configuration resulting when an additional actuator is provided in the hydraulic circuit system shown in FIG. 9.

FIG. 11 is a hydraulic circuit diagram resulted from providing a hydraulic cylinder 223 later as an additional actuator in the hydraulic circuit of FIG. 9. Comparing with the hydraulic circuit of FIG. 9, the hydraulic cylinder 223, a flow control valve 224, a pilot operating unit 225 and a shuttle valve 226 are added, and an output port of the shuttle valve 226 is connected to the port L of the shuttle block 215 through a line 227.

The flow control valve 224 is disposed in the most downstream side of the center bypass line 202*b*, and has a pump port connected to the hydraulic fluid supply line 202*c* in parallel to the pump ports of the other flow control valves 205, 206, 207.

The pilot operating unit 225 includes a pair of pilot valves (pressure reducing valves) built therein. The pilot valves convert the pilot pressure of the pilot pump 203 into a signal pressure G or H depending on the direction and input amount in and by which an associated control lever is manipulated. Output ports of the pilot operating unit 225, which provide the signal pressures G and H, are connected to hydraulic driving sectors at opposite ends of the flow control valve 224 through piping lines (not shown). The signal pressures G and H are introduced to the hydraulic driving sectors at opposite ends of the flow control valve 224 for shifting it.

The higher of the signal pressures G, H is detected by X the shuttle valve 226, and the detected signal pressure is introduced to the shuttle block 215 through the reserve port L. Then, as mentioned above, the higher of the output pressure of the shuttle valve 226 and the output pressure of the shuttle valve 220 is selectively detected by the reserve shuttle valve 221 and transmitted to the regulator 204.

With the above circuit diagram constructed for the additional actuator 223, the tilting (delivery capacity) of the hydraulic pump 202 can be controlled by the signal pressure G or H from the pilot operating unit 225 associated with the additional actuator 223.

The additional actuator 223 may be an actuator for a breaker or cracker (crusher) to be mounted on a hydraulic excavator, for example.

With this fourth embodiment thus constructed, the shuttle valves 216–220 are provided in the shuttle block 215, the reserve port L is formed in the block body 215*a* of the shuttle block 215, and the reserve shuttle valve 221 is provided in the shuttle block 215. Even in the case of providing the additional actuator 223 later, therefore, the tilting control of the hydraulic pump 202 can be simply achieved for the additional actuator 223 by connecting the pilot operating unit 225 associated with the additional actuator 223 to the reserve port L of the shuttle block 215.

Figure 12:
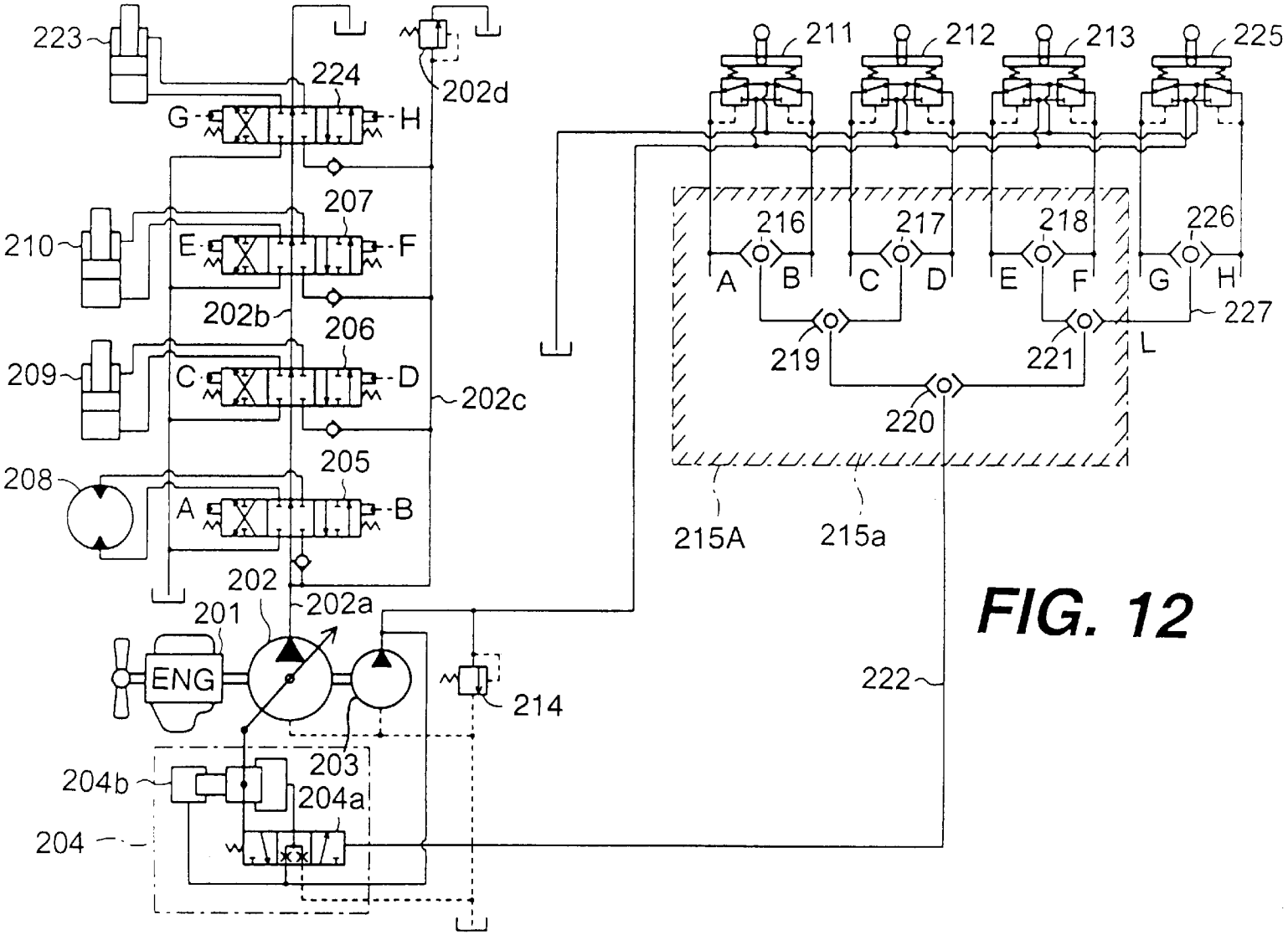
FIG. 12 is a hydraulic circuit diagram showing a modification of a shuttle block in the embodiment shown in FIG. 9.

While the reserve shuttle valve 221 for selecting the signal pressure for the additional actuator 223 is disposed downstream of the shuttle valve 220 in the illustrated embodiment, the layout of the shuttle valve 221 is not limited to the illustrated position. FIG. 12 shows one example of another layout of the shuttle valve 221. In a shuttle block 215A, the reserve shuttle valve 221 is disposed upstream of the shuttle valve 220 in a position adapted to select the higher of the pressure at the reserve port L and the output pressure of the shuttle valve 218. The higher of the output pressure of the shuttle valve 219 and the output pressure of the shuttle valve 221 is then selected by the shuttle valve 220 and transmitted to the regulator 204.

In this example, the operation signal pressures A, B, C, D, E and F from the pilot operating units 211, 212, 213 constitute operation signal pressures generated by a plurality of pilot operating units, but some of the operation signal pressures, e.g., E and F, constitute one predetermined group of operation signal pressures. Then, the shuttle valve 221 constitutes a reserve shuttle valve for selecting the higher of the maximum pressure in that group (i.e., the pressure selected by the shuttle valve 218) and the pressure at the reserve port L.

Figure 13:
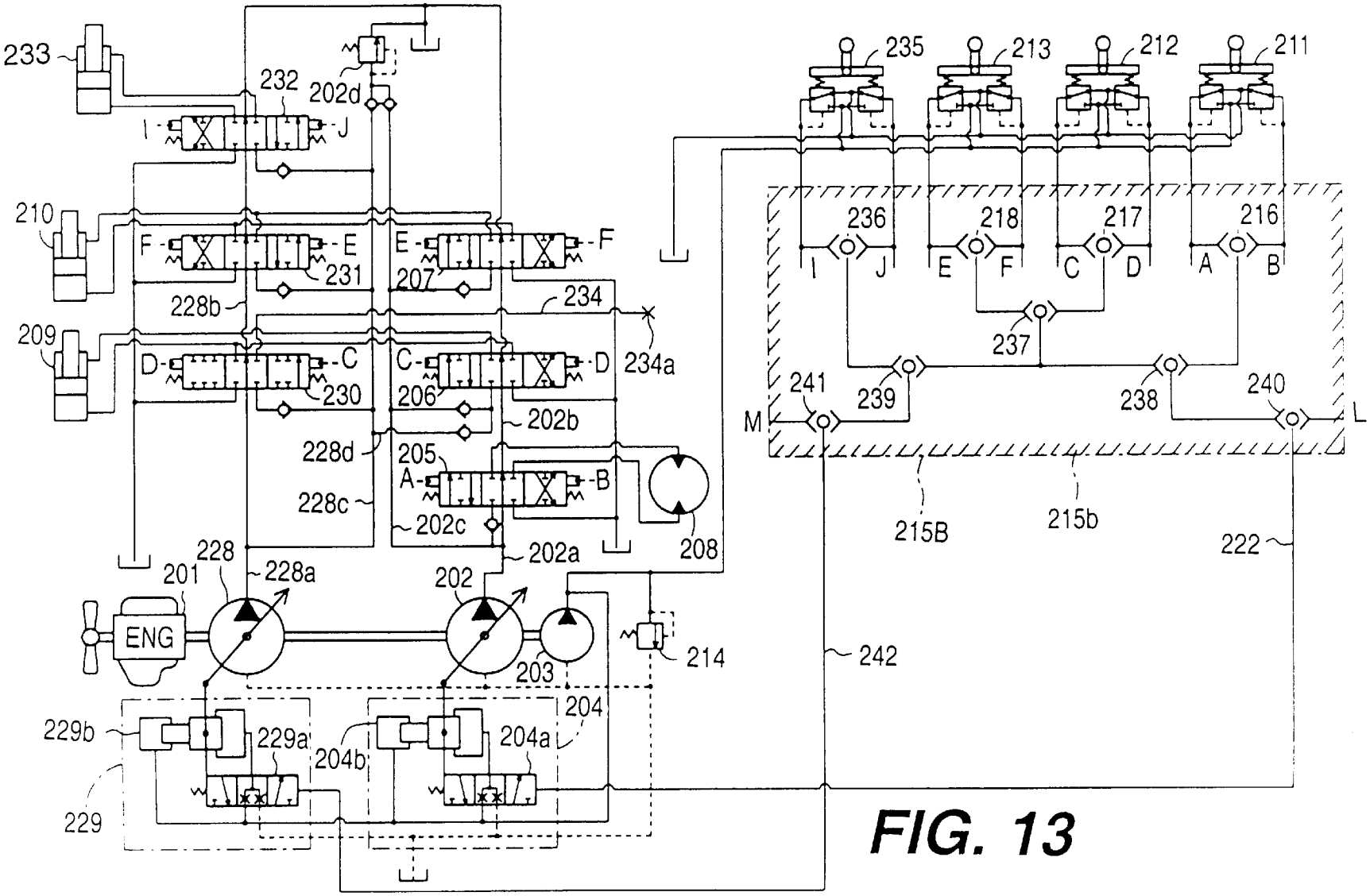
FIG. 13 is a hydraulic circuit diagram showing a hydraulic circuit system for a hydraulic working machine according to a sixth embodiment of the present invention.
Figure 14:
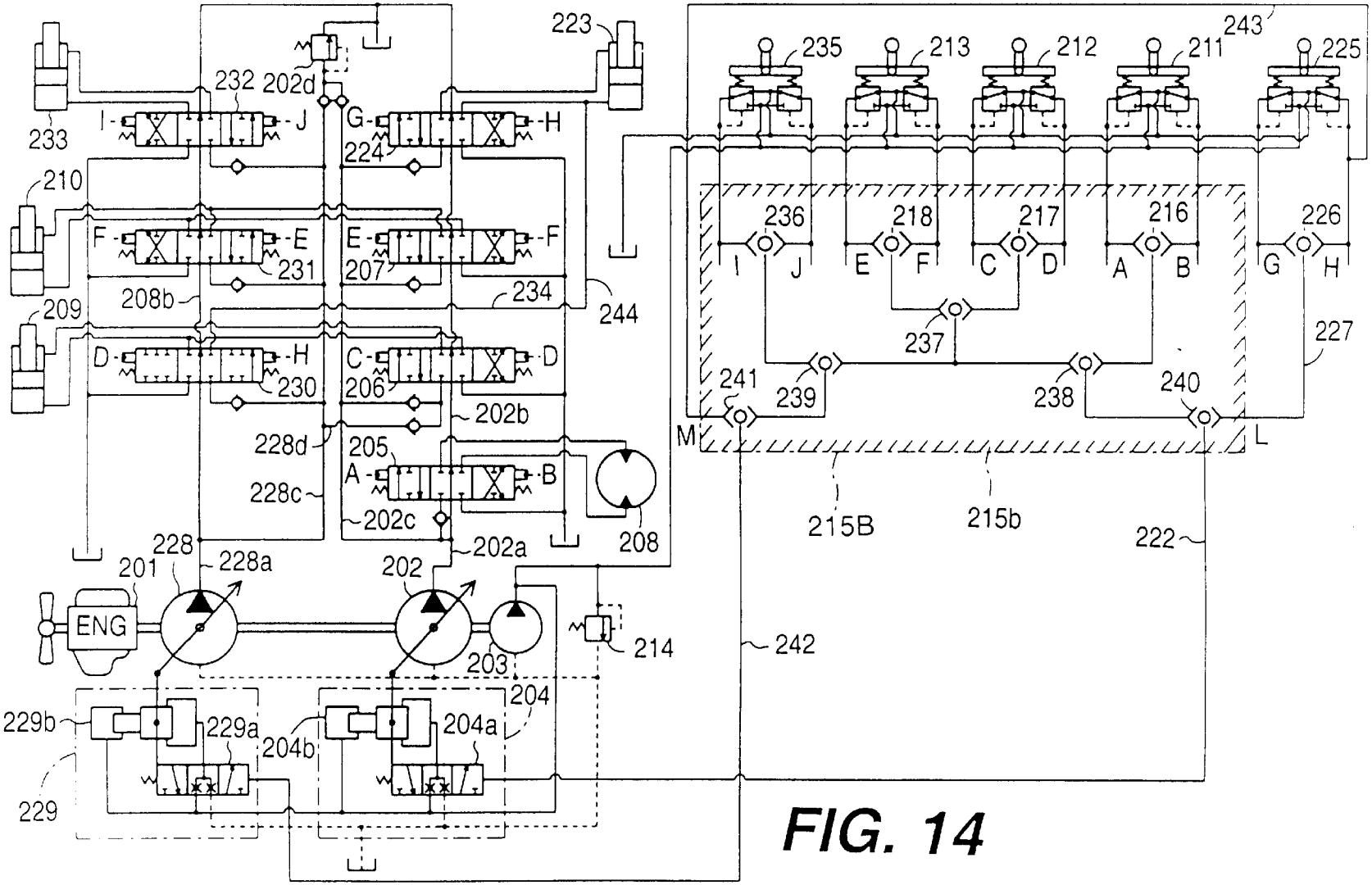
FIG. 14 is a hydraulic circuit diagram showing a configuration resulting when an additional actuator is provided in the hydraulic circuit system shown in FIG. 13.

A sixth embodiment of the present invention will be described below with reference to FIGS. 13 and 14. In FIGS. 13 and 14, equivalent members to those shown in FIGS. 9 and 11 are denoted by the same reference numerals. This sixth embodiment includes two main pumps.

In FIG. 13, hydraulic pumps 202, 228 as two main pumps and a pilot pump 203 are driven by an engine 201 for rotation. As with the hydraulic pump 202, the hydraulic pump 228 is a variable displacement pump whose tilting is controlled by a regulator 229, which comprises control valve 229*a* and a servo piston 229*b*, to control a pump delivery capacity.

Hydraulic fluids delivered from the hydraulic pumps 202, 228 are separately or jointly supplied to and returned from actuators, i.e., a hydraulic motor 208 and hydraulic cylinders 209, 210, 233, through shifting of flow control valves 205, 206, 207 and flow control valves 230, 231, 232.

As with the flow control valves 205, 206, 207, the flow control valves 230, 231, 232 are of the center bypass type. A center bypass line 228*b* is connected at its upstream end to a delivery line 228*a* of the hydraulic pump 228 and at its downstream end to a reservoir. Respective center bypass ports of the flow control valves 230, 231, 232 are connected in series to the center bypass line 228*b*. A hydraulic fluid supply line 228*c* is also connected to the delivery line 228*a* of the hydraulic pump 228, and respective pump ports of the flow control valves 230, 231, 232 are connected in parallel to the hydraulic fluid supply line 228*c*. A hydraulic fluid supply line 228*d* is branched from the hydraulic fluid supply line 228*c*. The pump port of the flow control valve 206 is connected to both the hydraulic fluid supply line 228*d* and the above-mentioned hydraulic fluid supply line 202*c* for the hydraulic pump 202. The hydraulic fluid supply line 228 is connected at its the downstream position to the hydraulic fluid supply line 202*c* at its downstream position, and further led to the reservoir through a relief valve 202*d* which serves as a safety valve.

The flow control valve 230 operates such that when the valve 230 is shifted from a neutral position, it closes the center bypass port to allow supply of the hydraulic fluid from the hydraulic pump 228 to the flow control valve 206, whereupon the hydraulic fluid from the hydraulic pump 228 and the hydraulic fluid from the hydraulic pump 202 can be supplied to the actuator 209 after being joined together. The end of an actuator line 234, which is connected to the hydraulic fluid supply line 228*c* when the flow control valve 230 is in its right-hand shift position as viewed on the drawing, is closed by a plug 234*a*.

As with the fifth embodiment, pilot operating units 211, 212, 213 are provided respectively for the actuators 208, 209, 210. The pilot operating units 211, 212, 213 convert a pilot pressure of the pilot pump 203 into signal pressures A or B, C or D and E or F depending on the direction and input amount in and by which associated control levers are manipulated. The signal pressures A, B are introduced to hydraulic driving sectors at opposite ends of the flow control valve 205 for shifting it, whereupon the hydraulic fluid delivered from the hydraulic pump 202 is solely supplied to the actuator 208. The signal pressures C, D are introduced to hydraulic driving sectors at opposite ends of the flow control valve 206, 230 for shifting them, whereupon the hydraulic fluids delivered from the hydraulic pumps 202, 228 are joined and supplied to the actuator 209 after passing the flow control valve 206 together. The signal pressures E, F are introduced to hydraulic driving sectors at opposite ends of the flow control valve 207, 231 for shifting them, whereupon the hydraulic fluids delivered from the hydraulic pumps 202, 228 are joined and supplied to the actuator 210 after passing the flow control valves 207, 231, respectively.

Further, a pilot operating unit 235 is provided for the actuator 233. As with the pilot operating units 211, 212, 213, the pilot operating unit 235 includes a pair of pilot valves (pressure reducing valves) built therein. The pilot valves convert the pilot pressure of the pilot pump 203 into a signal pressure I or J depending on the direction and input amount in and by which an associated control lever is manipulated. The signal pressures I, J are introduced to hydraulic driving sectors at opposite ends of the flow control valve 232 for shifting it, whereupon the hydraulic fluid delivered from the hydraulic pump 228 is solely supplied to the actuator 233.

A shuttle block 215B comprises a block body 215*b* and a plurality of shuttle valves 216–218, 236, 237, 238, 239, 240 and 241 built in the block body 215*b*. The maximum of signal pressures from the pilot operating units 211, 212, 213 is detected by the shuttle valves 216, 217, 218, 237 and 238, and the detected maximum pressure is transmitted to the regulator 204 for the hydraulic pump 202 through the shuttle valve 240 and a line 222. The maximum of signal pressures from the pilot operating units 212, 213, 235 is detected by the shuttle valves 217, 218, 236, 237 and 239, and the detected maximum pressure is transmitted to the regulator 229 for the hydraulic pump 228 through the shuttle valve 241 and a line 242.

In the shuttle block 215B, the shuttle valves 240, 241 are provided for reserve to be used when actuators are added, and reserve ports L, M are formed in the block body 215*b* corresponding to the shuttle valves 240, 241. The higher of the pressure at the reserve port L and the output pressure of the shuttle valve 238 is detected by the reserve shuttle valve 240. The higher of the pressure at the reserve port M and the output pressure of the shuttle valve 239 is detected by the reserve shuttle valve 241.

In the above construction, the hydraulic pump 202 constitutes a first hydraulic pump, and the hydraulic pump 228 constitutes a second hydraulic pump. The operation signal pressures A, B, C, D, E, F, I and J from the pilot operating units 211, 212, 213 and 235 constitute operation signal pressures generated by a plurality of pilot operating units. Of those operation signal pressures, A, B, C, D, E and F constitute a group of operation signal pressures for the first hydraulic pump, and the maximum pressure finally selected by the shuttle valve 238 from that group of operation signal pressures constitutes a first maximum pressure. Also, the operation signal pressures C, D, E, F, I and J constitute a group of operation signal pressures for the second hydraulic pump, and the maximum pressure finally selected by the shuttle valve 239 from that group of operation signal pressures constitutes a second maximum pressure.

Also, the reserve port L constitutes a first reserve port and the reserve port M constitutes a second reserve port. The shuttle valve 240 constitutes a first reserve shuttle valve for selecting, as a first control signal pressure, the higher of the pressure at the first reserve port and the first maximum pressure. The shuttle valve 241 constitutes a second reserve shuttle valve for selecting, as a second control signal pressure, the higher of the pressure at the second reserve port and the second maximum pressure. Further, the regulator 204 constitutes a first regulator operated in accordance with the first control signal pressure, and the regulator 229 constitutes a second regulator operated in accordance with the second control signal pressure.

FIG. 14 is a hydraulic circuit diagram resulted from providing a hydraulic cylinder 223 later as an additional actuator in the hydraulic circuit of FIG. 13. Comparing with the hydraulic circuit of FIG. 13, the hydraulic cylinder 223, a flow control valve 224, a pilot operating unit 225 and a shuttle valve 226 are added, an output port of the shuttle valve 226 is connected to the port L of the shuttle block 215B through a line 227, and an output port of the pilot operating unit 225, which provides a signal pressure H, is connected to the port M of the shuttle block 215B through a line 243.

The flow control valve 224 is disposed in the most downstream side of the center bypass line 202*b*, and has a pump port connected to the hydraulic fluid supply line 202*c* in parallel to the pump ports of the other flow control valves 205, 206, 207. Moreover, the hydraulic cylinder 223 is connected at the bottom side thereof to the actuator line 234 of the flow control valve 230 through a merging line 244. At the time of connecting the merging line 244 to the actuator line 234, the plug 234*a* (see FIG. 13) of the actuator line 234 is removed.

Output ports of the pilot operating unit 225, which provide the signal pressures G and H, are connected to hydraulic driving sectors at opposite ends of the flow control valve 224 through piping lines (not shown). In addition, the output port for the signal pressure H is now connected to the hydraulic driving sector at one end of the flow control valve 230 to which the signal pressure C has been introduced in FIG. 13. With such a change of the hydraulic circuit, the signal pressures G, H generated by the pilot operating unit 225 is introduced to the hydraulic driving sectors at opposite ends of the flow control valve 224 for shifting it. The hydraulic fluid delivered from the hydraulic pump 202 is thereby solely supplied to the actuator 223. Also, the signal pressure H is introduced to the hydraulic driving sector at one end of the flow control valve 230 for shifting it to the left on the drawing. The hydraulic fluids delivered from the hydraulic pumps 202, 228 are thereby joined and supplied to the bottom side of the hydraulic cylinder 223 (in the direction to extend it).

The higher of the signal pressures G, H is detected by the shuttle valve 226, and the detected signal pressure is introduced to the shuttle block 215B through the reserve port L. Then, as mentioned above, the higher of the output pressure of the shuttle valve 226 and the output pressure of the shuttle valve 238 is detected by the reserve shuttle valve 240 and transmitted to the regulator 204. Also, the signal pressure H is introduced to the shuttle block 215B through the reserve port M. Then, as mentioned above, the higher of the signal pressure H and the output pressure of the shuttle valve 239 is detected by the reserve shuttle valve 241 and transmitted to the regulator 229.

With the above circuit diagram constructed for the additional actuator 223, the tilting (delivery capacity) of the hydraulic pump 202 can be controlled by the signal pressure G from the pilot operating unit 225 associated with the additional actuator 223 so that the hydraulic fluid from the hydraulic pump 202 is solely supplied to the actuator 223 as described above. Furthermore, the tilting (delivery capacity) of each of the hydraulic pumps 202, 228 can be controlled by the signal pressure H so that the hydraulic fluids from the hydraulic pumps 202, 228 are joined and supplied to the actuator 223 as described above. Stated otherwise, in the operation of contracting the hydraulic cylinder 223 as the additional actuator, the control is made to increase the capacity of the hydraulic pump 202 alone, and in the operation of extending the hydraulic cylinder 223, the control is made to increase the capacity of both the hydraulic pumps 202, 228. Accordingly, the hydraulic cylinder 223 can be quickly moved in the extending direction as well, which is particularly advantageous when the present invention is applied to actuators needing a large flow rate, such as a cracker.

With this sixth embodiment thus constructed, even in the hydraulic circuit system including the two hydraulic pumps 202, 228, the capacity control of the hydraulic pumps 202, 228 can be easily achieved for the additional actuator 223 by connecting the pilot operating unit 225 associated with the additional actuator 223 to the reserve ports L, M of the shuttle block 215B.

Figure 15:
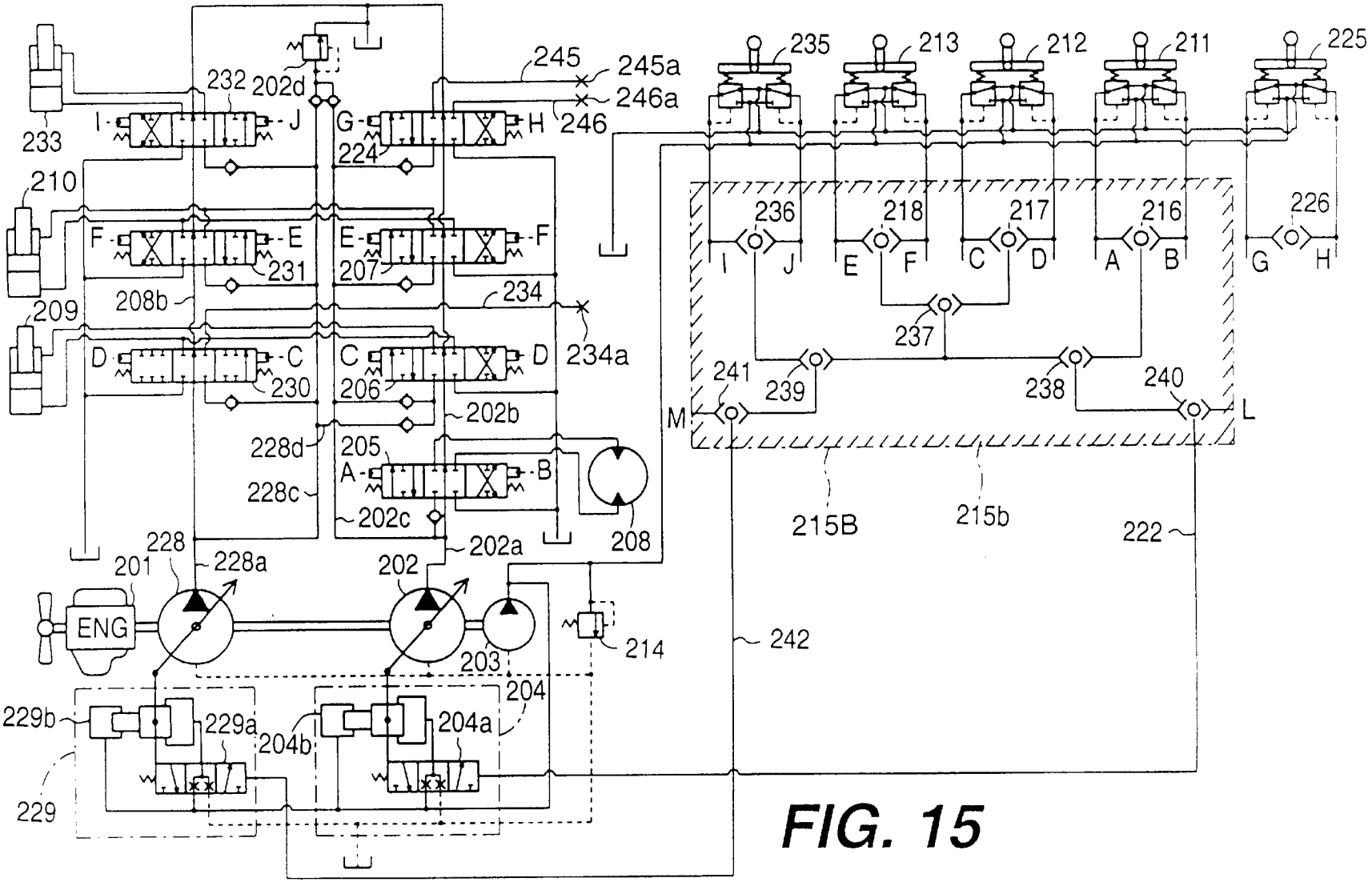
FIG. 15 is a hydraulic circuit diagram showing a hydraulic circuit system for a hydraulic working machine according to a seventh embodiment of the present invention.

A seventh embodiment of the present invention will be described below with reference to FIG. 15. In FIG. 15, equivalent members to those shown in FIGS. 9 and 13 are denoted by the same reference numerals. In this seventh embodiment, a reserve flow control valve 224 and a reserve pilot operating unit 225 are assembled beforehand in the hydraulic circuit system of FIG. 13. The ends of actuator lines 245, 246 of the flow control valve 224 are closed by respective plugs 245*a*, 246*a* similarly to the actuator line 234.

A circuit configuration resulted from providing the additional actuator 233 in the hydraulic circuit system of FIG. 15 is the same as that of the sixth embodiment shown in FIG. 14. Specifically, the output port of the shuttle valve 226 is connected to the port L of the shuttle block 215B through the line 227, and the output port of the pilot operating unit 225, which provides the signal pressure H, is connected to the port M of the shuttle block 215B through the line 243. Then, after removing the plugs 234*a*, 245*a*, 246*a* of the actuator lines 234, 245, 246, the additional hydraulic cylinder 223 is connected to the actuator lines 234, 245, 246 through the merging line 244 and other appropriate lines.

With this seventh embodiment, since a part to be added is only the actuator 233, the work needed for providing the additional actuator is more simplified.

Incidentally, the control device, which is operated in accordance with the maximum pressure detected by the shuttle valve, has been described in the above fifth to seventh embodiments as being a regulator for capacity control of a hydraulic pump. However, the control device operated in accordance with the maximum pressure detected by the shuttle valve may be a swing brake cylinder, a track communicating valve, or the like which are used in the above first to fourth embodiments, and the present invention can also be likewise applied to a hydraulic circuit system including such another control device while providing the similar advantages.

An eighth embodiment of the present invention will be described below with reference to FIGS. 16–20. In this eighth embodiment, a motor trouble is avoided during work of dropping mud from a hydraulic excavator by separating a signal for operating the track communicating valve and a signal for operating the swing brake cylinder from each other within a shuttle block.

Figure 16:
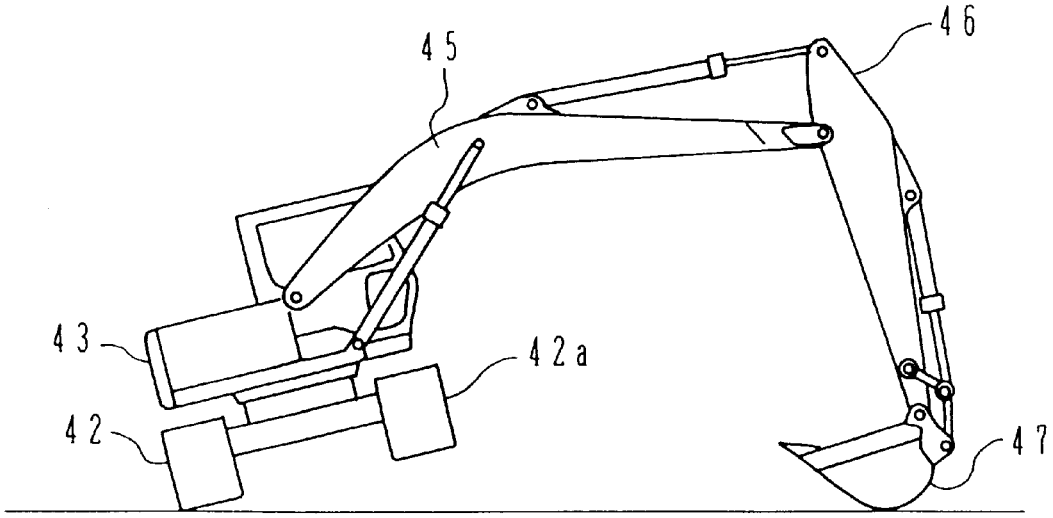
FIG. 16 is a view for explaining work of dropping mud from a hydraulic excavator according to an eighth embodiment of the present invention, the excavator being in a jacked-up state.

Generally, as a hydraulic excavator repeats traveling in the work site of excavation, earth/sand, mud and so on are gradually deposited on the crawlers 42*a* (see FIG. 3). If the amount of deposits on the crawlers 42*a* is too enlarged, smooth traveling of the excavator would be impeded and loads imposed on the track motors 13, 5 would be so increased, which is not desired from the standpoint of energy saving. The operator therefore performs work of dropping mud from the crawlers 42*a* at proper timing. More specifically, as shown in FIG. 16, the pilot operating unit 53 for swing (see FIG. 4) is operated to swing the upper swing structure 43 by 90° from a state directing straight forward to a state directing to the left (or the right). After that, the pilot operating unit 51 for the boom and the pilot operating unit 52 for the arm are operated to make the bucket 47 contacted with the ground surface by lowering the boom and crowding the arm. The crawler 42*a* on the left (or right) side is then elevated (jacked up) above the ground surface into the air by further crowing the arm, for example. In this condition, the pilot operating unit 49 for the left track (or the pilot operating unit 48 for the right track) is operated to idly drive the crawler 42*a* which is elevated into the air, thereby dropping mud deposited on the crawler 42*a* down to the ground surface.

During such mud dropping work, because the upper swing structure 43 and the lower track structure 42 are in a fairly inclined condition, the dead weight of the hydraulic excavator tends to operate the boom 45 in the rising direction, the arm 46 in the dumping direction, or the bucket 47 in the crowding direction, causing the elevated crawler 42*a* to gradually descend. In such a case, the operator often tries to restore the hydraulic excavator to the original posture by lowering the boom, crowing the arm, or dumping the bucket. Since the combined operation of track and front is performed in that case, the track communicating valve 26 is opened by the front/swing operation signal Xf, as described above, in the first embodiment.

In the case of dropping mud from the left-hand crawler 42*a* as shown in FIG. 16, the shift amount of the first-arm flow control valve 10 is small and most of the hydraulic fluid from the main hydraulic pump 1*b* is supplied to the left-track motor 38 in FIGS. 1 and 2. In addition, because loads imposed on the arm cylinder 36 and the bucket cylinder 34 during the operations of arm crowding and bucket dumping are relatively larger than a load imposed on the left-track motor 38 which is idly rotating, the hydraulic fluid from the main hydraulic pump 1*a* is also supplied to the left-track motor 38 through the communicating line 41. Accordingly, the hydraulic fluids from the two pumps are mostly supplied to the left-track motor 38, whereby the left-track motor 38 may rotate overly and hence cause seizing.

Figure 17:
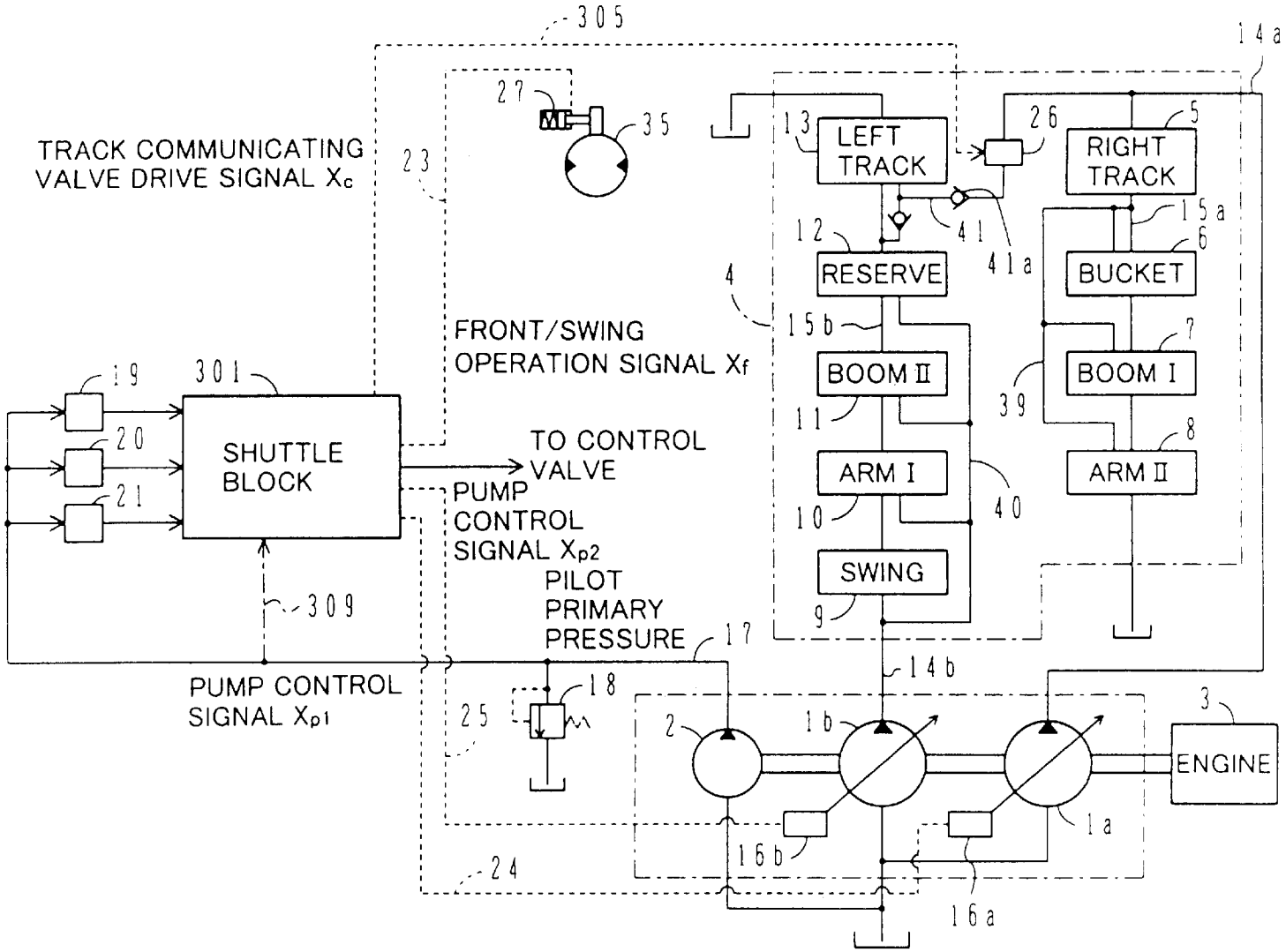
FIG. 17 is a hydraulic circuit diagram showing a hydraulic circuit system for a hydraulic working machine according to the eighth embodiment of the present invention.
Figure 18:
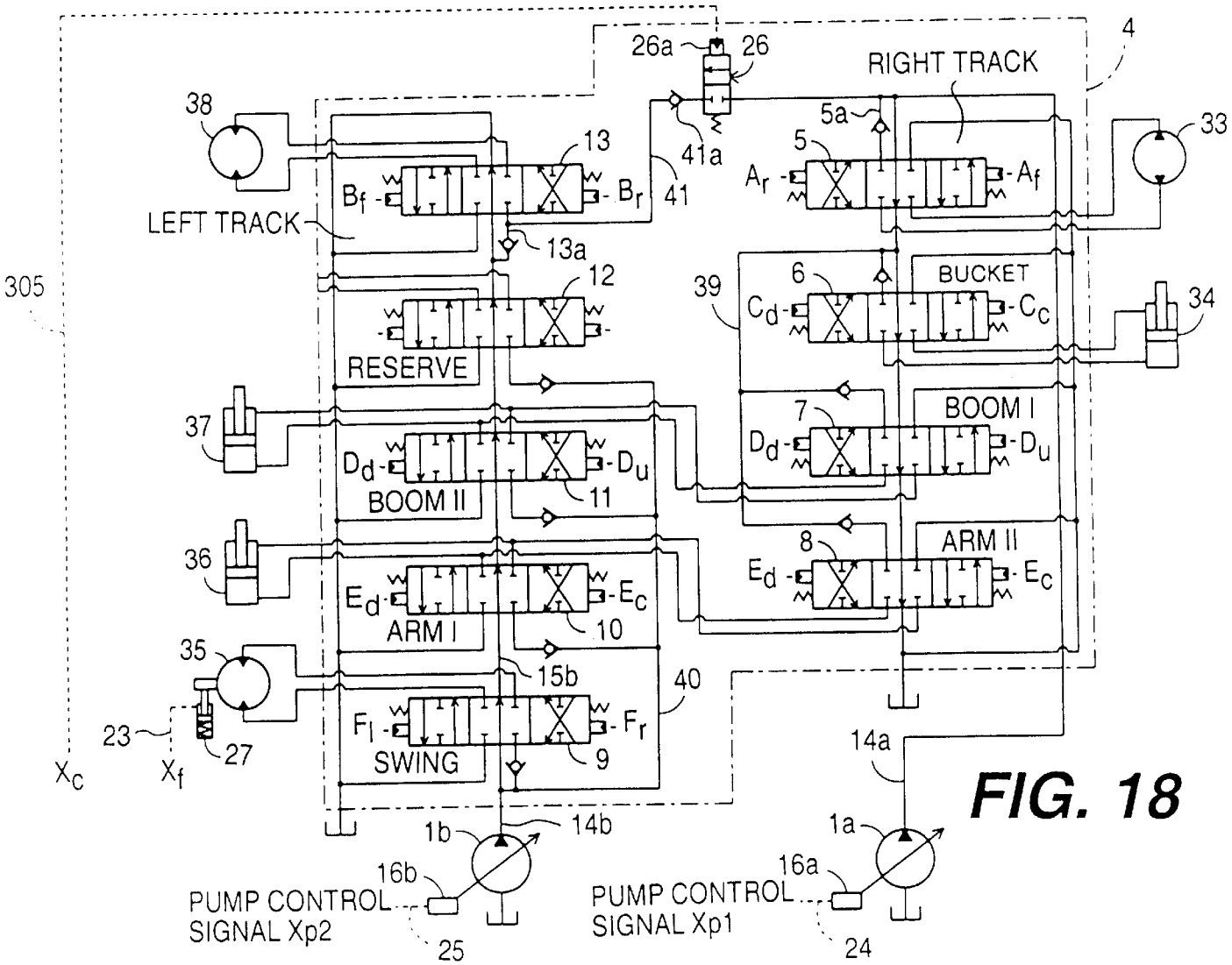
FIG. 18 is a diagram showing details of a valve unit of the hydraulic circuit system shown in FIG. 17.
Figure 19:
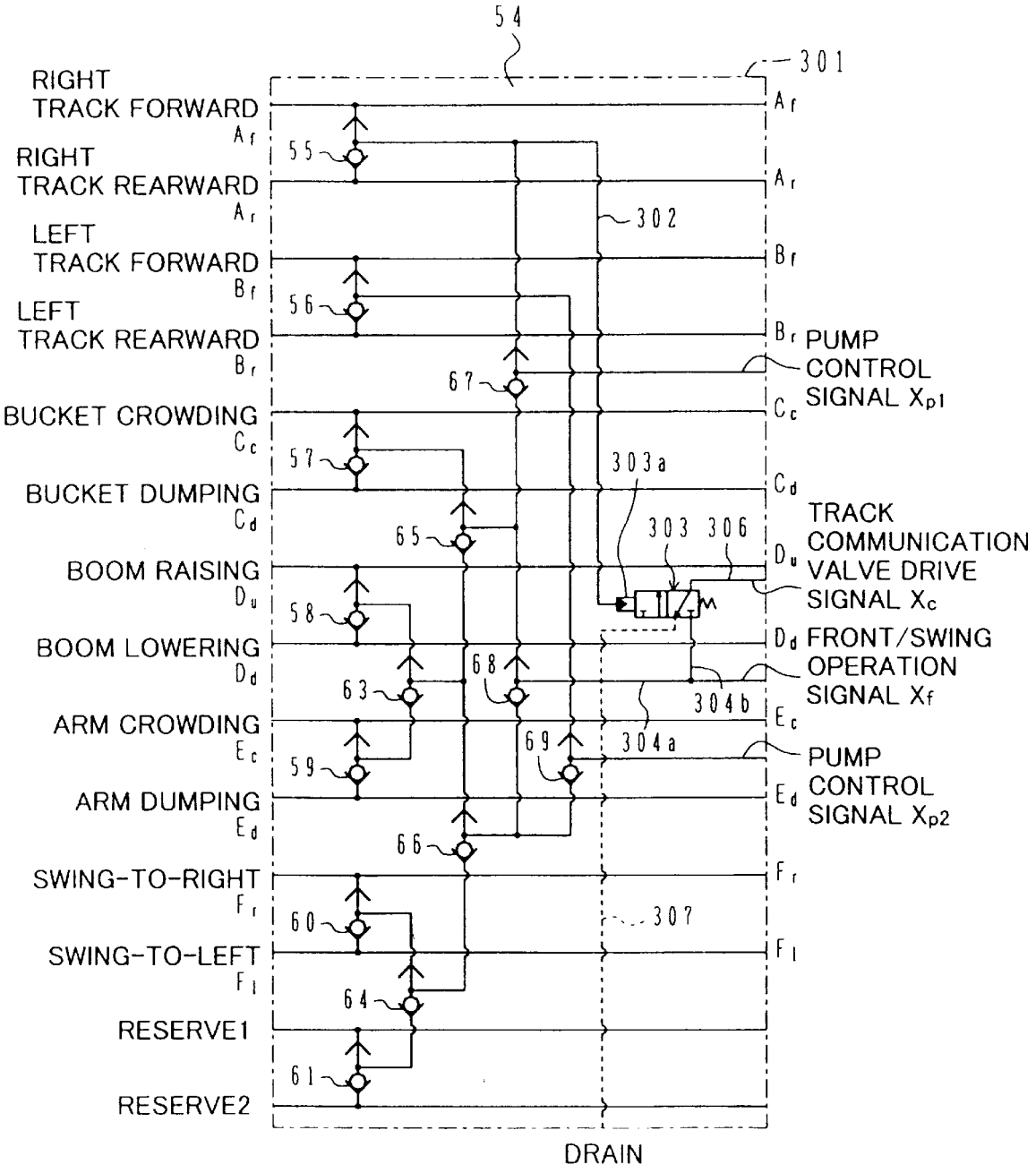
FIG. 19 is a diagram showing details of a shuttle block shown in FIG. 17.

This eighth embodiment intends to surely avoid the occurrence of such a trouble. FIG. 17 shows a hydraulic circuit diagram of a hydraulic circuit system according to this embodiment, FIG. 18 shows details of a valve unit of the hydraulic circuit system shown in FIG. 17, and FIG. 19 shows details of a shuttle block shown in FIG. 17. FIGS. 17, 18 and 19 correspond respectively to FIGS. 1, 2 and 5 for the first embodiment. Equivalent members in FIGS. 17, 18 and 19 to those shown in FIGS. 1, 2 and 5 are denoted by the same reference numerals, and the description thereof is omitted unless particularly needed.

In FIGS. 17–19, the hydraulic circuit system of this embodiment has a shuttle block 301 in which there are built fourteen shuttle valves 55–61 and 63–69, a line 302 for transmitting the higher of the right-track forward and rearward operation signal pressures Af, Ar selected by the shuttle valve 55, a hydraulic selector valve 303 serving as a second selector valve which is shifted between a communicating position (left-hand position in FIG. 19) and a cutoff position (right-hand position in FIG. 19) upon whether or not the selected maximum pressure is introduced to a pressure receiving sector 303*a* through the line 302, a line 304*a* for transmitting the front/swing operation signal Xf selected by the shuttle valve 68 to the signal line 23 which is led to the brake cylinder 27, a line 304*b* branched from the line 304*a*, a signal line 306 connected to a signal line 305 for transmitting a pressure signal in the line 304*b*, as a track communicating valve drive signal Xc, to the track communicating valve 26 through the hydraulic selector valve 303, and a line 307 for drain.

The hydraulic selector valve 303 has a pressure receiving sector 303*a* to which the maximum pressure selected by the shuttle valve 55 is introduced, and is operated in accordance with that maximum pressure to introduce the front/swing operation signal Xf, as the track communicating valve drive signal Xc, to the line 306. When the maximum pressure selected by the shuttle valve 55 is substantially equal to the reservoir pressure, the hydraulic selector valve 303 is held in the cutoff position where the hydraulic fluid in both the signal lines 305, 306 is introduced to the drain line 307. On the other hand, when the maximum pressure selected by the shuttle valve 55 rises, the hydraulic selector valve 303 is shifted to the communicating position where the front/swing operation signal Xf is output as the track communicating valve drive signal Xc. The track communicating valve 26 is thus operated by the track communicating valve drive signal Xc.

In the illustrated construction, the main hydraulic pumps 1*a*, 1*b* constitute respectively third and fourth hydraulic pumps. The right-track motor 33 constitutes a first track motor, the left-track motor 38 constitutes a second track motor, and the boom cylinder 37, the arm cylinder 36 and the bucket cylinder 34 constitute front actuators. The flow control valve 5 for the right track constitutes a first-track flow control valve, and the flow control valve 13 for the left track constitutes a second-track flow control valve. Further, the first boom flow control valve 7, the second boom flow control valve 11, the first arm flow control valve 10, the second arm flow control valve 8, and the flow control valve 6 for the bucket constitute front flow control valves.

Also, an input port 5*a* of the flow control valve 5 for the right track constitutes a hydraulic fluid supply line for the first-track flow control valve, an input port 13*a* of the flow control valve 13 for the left track constitutes a hydraulic fluid supply line for the second-track flow control valve, and the communicating line 41 constitutes a communicating line for communicating those two hydraulic fluid supply lines with each other. The track communicating valve 26 constitutes a first selector valve capable of opening and closing the communicating line.

The pilot operating unit 48 for the right track (see FIG. 4) constitutes a first-track pilot operating unit, while the pilot operating unit 51 for the boom, the pilot operating unit 52 for the arm, the pilot operating unit 50 for the bucket constitute front pilot operating units.

The shuttle valve 55 constitutes a first-track shuttle valve for selecting a first-track maximum pressure of operation signal pressures generated by the first-track pilot operating unit. The shuttle valves 57, 58, 59, 63, 65 and 68 constitute front shuttle valves for selecting a front maximum pressure of operation signal pressures generated by the front pilot operating unit.

Additionally, the hydraulic selector valve 303, the signal line 306 and the signal line 305 constitute a switching signal output means for generating and outputting a switching signal to shift the first selector valve into the open state when both operation signals are introduced to the means through the first-track shuttle valve and the front shuttle valves.

The operation of this embodiment thus constructed will be described below.

(1) Combined Operation of Front Actuator 37, 36, 34 or Swing Motor 35 and Left- and Right-Track Motors 38, 33

When the operator manipulates not only both the pilot operating units 48, 49 for the right and left tracks, but also at least one of the pilot operating units 50–53 for the bucket, boom, arm and swing with intent to carry out such a combined operation, generated operation signal pressures are applied to the flow control valves 5, 13 and corresponding one or more of the flow control valves 6–11. At the same time, the maximum of the operation signal pressures from the pilot operating unit 50 for the bucket, the pilot operating unit 51 for the boom, the pilot operating unit 52 for the arm, and the pilot operating unit 53 for swing is selected by the shuttle valves 57, 58, 59, 60, 63, 64, 65, 66 and 68, and then introduced as the front/swing operation signal Xf to the lines 304*a*, 304*b*. On the other hand, the maximum of the operation signal pressures from the pilot operating unit 48 for the right track is selected by the shuttle valve 55 and then introduced to the hydraulic selector valve 303 through the line 302, whereupon the hydraulic selector valve 303 is shifted from the cutoff position to the communicating position.

Accordingly, the front/swing operation signal Xf is output as the track communicating valve drive signal Xc from the hydraulic selector valve 303 to the signal line 306 for shifting the track communicating valve 26 to the communicating position through the signal line 305, allowing the hydraulic fluid delivered from the main hydraulic pump 1*a* to flow into not only the flow control valve 5, but also the flow control valve 13 through a check valve 41*a* in the communicating line 41. Therefore, even when the hydraulic fluid delivered from the main hydraulic pump 1*b* is supplied to one or more of the flow control valves 9, 10, 11 upstream of the flow control valve 13 with priority, the hydraulic fluid delivered from the main hydraulic pump 1*a* can be supplied to both the track motors 33, 38. As a result, the combined operation of tracks and front/swing can be performed and the excavator can travel with good straightforwardness.

(2) Combined Operation of Front Actuator 37, 36, 34 and Left-Track Motor 38 during Work of Dropping Mud from Left-Hand Crawler 42*a*

When the operator manipulates not only the pilot operating unit 49 for the left track, but also at least one of the pilot operating units 50–52 with intent to carry out such a combined operation, generated operation signal pressures are applied to the flow control valve 13 and corresponding one or more of the flow control valves 6, 7, 8, 10 and 11. At the same time, the maximum of the operation signal pressures from the pilot operating units 50–52 is selected by the shuttle valves 57, 58, 59, 63, 65 and 68, and then introduced as the front/swing operation signal Xf to the lines 304*a*, 304*b*. Because of the pilot operating unit 48 for the right track being not operated, however, the hydraulic selector valve 303 is held in the cutoff position and the hydraulic fluid in the signal lines 306, 305 is communicated with the drain line 307, whereby the track communicating valve 26 is held in the cutoff position. Accordingly, the hydraulic fluid from the main hydraulic pump 1*a* is supplied to corresponding one or more of the front actuators 34, 37, 36 through one or more of the flow control valves 6, 7, 8 which are shifted. Also, part of the hydraulic fluid from the main hydraulic pump 1*b* is supplied to corresponding one of the front actuators 36, 37 through one of the flow control valves 10, 11 which is operated, while the remaining hydraulic fluid is supplied to the left-track motor 38 through the flow control valve 13 for the left track. Thus, since only the hydraulic fluid from the main hydraulic pump 1*b* is supplied to the left-track motor 38, it is possible to protect the left-track motor 38 from overly rotating by being supplied with the hydraulic fluids from the main hydraulic pumps 1*a*, 1*b* unlike the first embodiment.

(3) Combined Operation of Front Actuator 37, 36, 34 and Right-Track Motor 33 during Work of Dropping Mud from Right-Hand Crawler 42*a*

When the operator manipulates not only the pilot operating unit 48 for the right track, but also at least one of the pilot operating units 50–52 with intent to carry out such a combined operation, generated operation signal pressures are applied to the flow control valve 5 and corresponding one or more of the flow control valves 6, 7, 8, 10 and 11. At the same time, the maximum of the operation signal pressures from the pilot operating units 50–52 is selected by the shuttle valves 57, 58, 59, 63, 65 and 68, and then introduced as the front/swing operation signal Xf to the lines 304*a*, 304*b*. On the other hand, the maximum of the operation signal pressures from the pilot operating unit 48 for the right track is selected by the shuttle valve 55 and then introduced to the hydraulic selector valve 303 through the line 302, whereupon the hydraulic selector valve 303 is shifted from the cutoff position to the communicating position.

Accordingly, the track communicating valve drive signal Xc is output from the hydraulic selector valve 303 to the signal lines 306, 305 for shifting the track communicating valve 26 to the communicating position where the communicating line 41 is made open thoroughly. Because of the flow control valve 13 for the left track being not operated and held in its neutral position, however, the hydraulic fluid from the main hydraulic pump 1*a* is not supplied to the left-track motor 38, but supplied to the right-track motor 33 alone. On that occasion, part of the hydraulic fluid from the main hydraulic pump 1*b* is supplied to corresponding one of the front actuators 36, 37 through one of the flow control valves 10, 11 which is operated, while the remaining hydraulic fluid is introduced to the input port 13*a* of the flow control valve 13 for the left track. The introduced hydraulic fluid is however blocked from flowing into the side of the flow control valve 5 for the right track by the check valve 41*a* disposed in the communicating line 41. As a result, only the hydraulic fluid from the main hydraulic pump 1*a* is supplied to the right-track motor 33 and hence the right-track motor 33 is protected from overly rotating.

As described above, in addition to the similar advantages as obtainable with the above first embodiment, this eighth embodiment can provide an advantage that when at least one of the front actuators 34, 36, 37 and the track motor 33 or 38 are simultaneously operated during the work of dropping mud from the hydraulic excavator, the hydraulic fluids from the two pumps are avoided from being concentrated on one of the track motors, and that track motor is protected from overly rotating.

Figure 20:
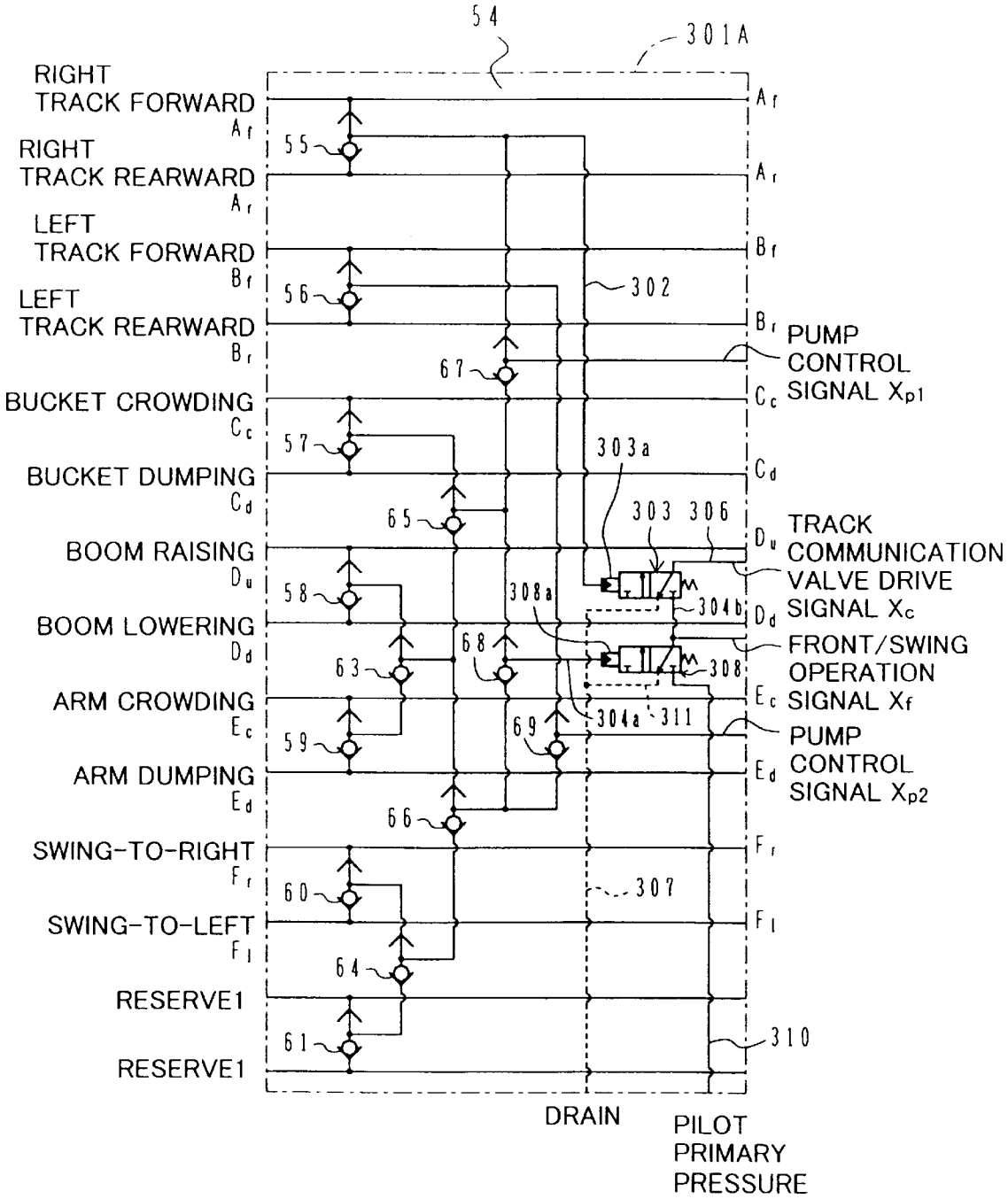
FIG. 20 is a diagram showing details of a shuttle block in a hydraulic circuit system for a hydraulic working machine according to a ninth embodiment of the present invention.
Figure 21:
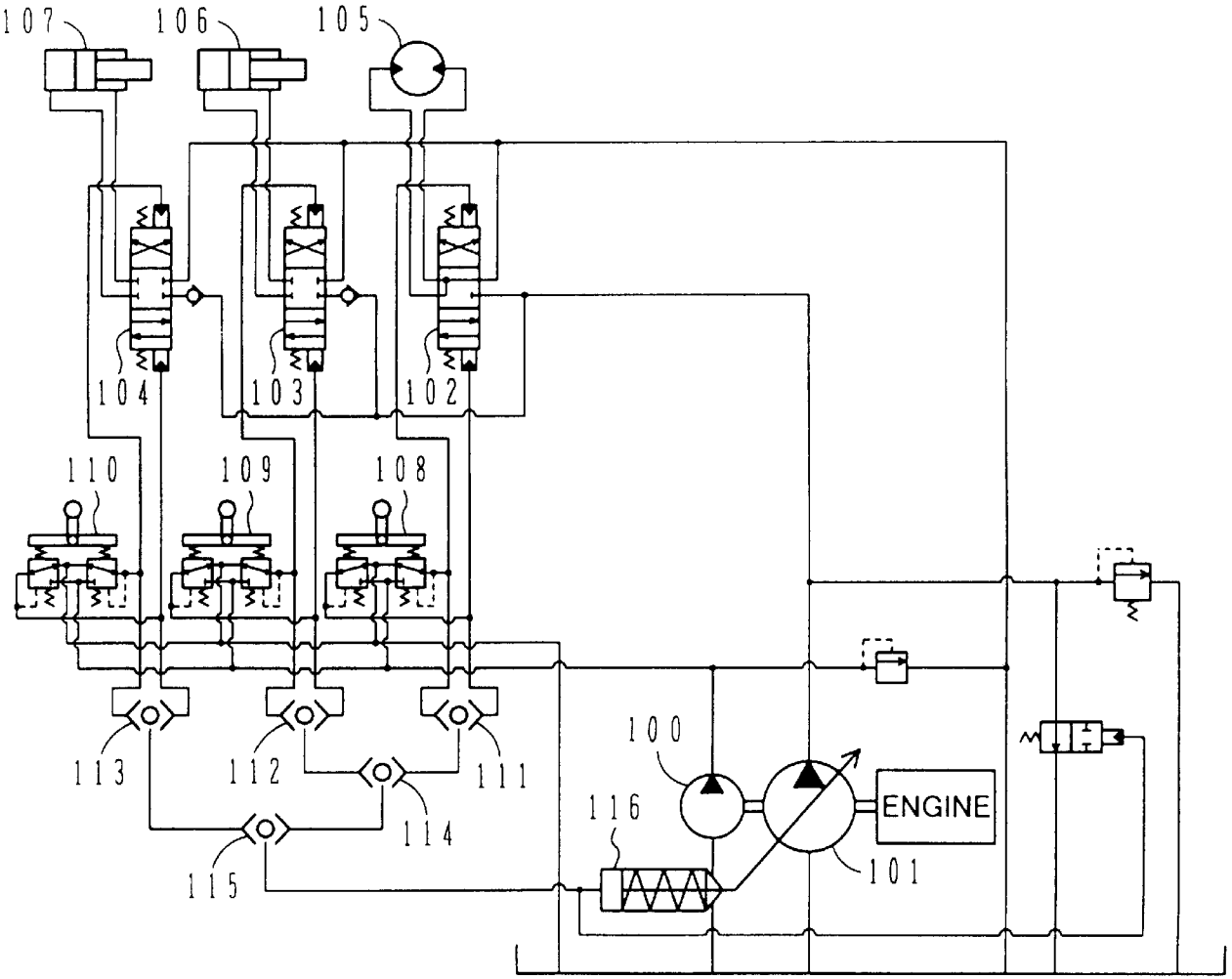
FIG. 21 PRIOR ART
FIG. 21 is a hydraulic circuit diagram showing a hydraulic circuit system of the prior art.
Figure 22:
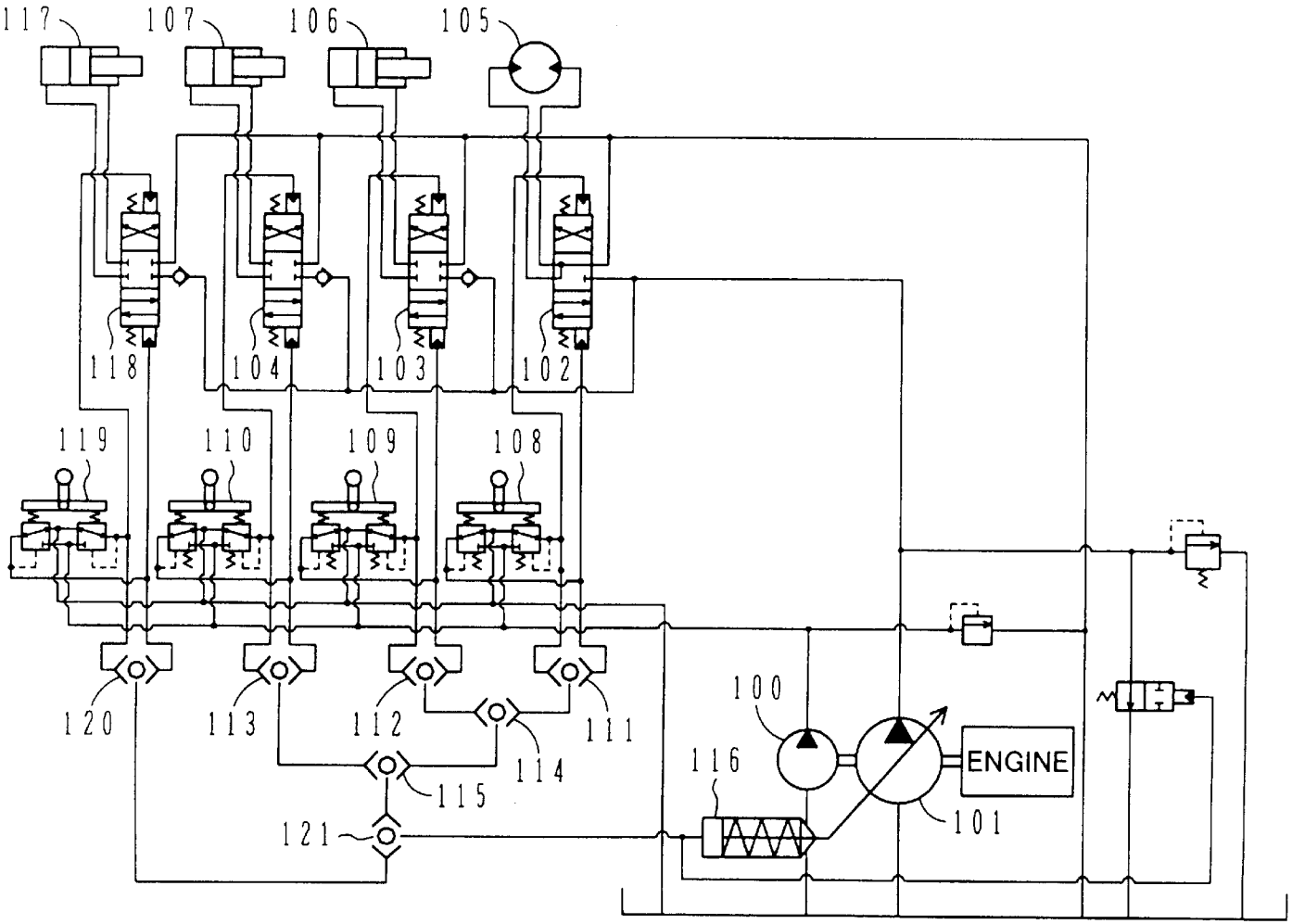
FIG. 22 is a hydraulic circuit diagram showing a configuration resulting when an additional actuator is provided in the hydraulic circuit system of the prior art shown in FIG. 21.

A ninth embodiment of the present invention will be described below with reference to FIG. 20. In FIG. 20, common members to those shown in FIGS. 17–19 are denoted by the same reference numerals and the description thereof is omitted unless particularly needed.

FIG. 20 shows a detailed structure of a shuttle block 301A as principal part of a hydraulic circuit system according to this ninth embodiment, and corresponds to FIG. 19. The hydraulic circuit system of this ninth embodiment differs from the system of the above eighth embodiment in that the shuttle block 301A additionally incorporates therein a hydraulic selector valve 308 serving as a third selector valve which is shifted between a communicating position (left-hand position in FIG. 20) and a cutoff position (right-hand position in FIG. 20) upon whether or not the front/swing operation signal Xf selected by the shuttle valve 68 is introduced to a pressure receiving sector 308*a*, a line 310 connected to a line 309 (indicated by a two-dot-chain line in FIG. 17), which is branched from the delivery line 17 of the pilot pump 2, for transmitting a pilot primary pressure, and a line 311 for connecting the drain line 307 to the hydraulic selector valve 303.

The hydraulic selector valve 308 has a pressure receiving sector 308*a* to which the maximum pressure selected by the shuttle valve 68 is introduced, and is operated in accordance with that maximum pressure to output, as the front/swing operation signal Xf, the pilot primary pressure introduced through the line 310. When the maximum pressure selected by the shuttle valve 68 is substantially equal to the reservoir pressure, the hydraulic selector valve 308 is held in the cutoff position where the hydraulic fluid in the signal line 23 is introduced to the drain line 307 through the line 311. On the other hand, when the maximum pressure selected by the shuttle valve 68 rises, the hydraulic selector valve 308 is shifted to the communicating position where the pilot primary pressure is output as the front/swing operation signal Xf. The swing brake cylinder 27 is thus operated by the front/swing operation signal Xf.

The hydraulic selector valve 303 is operated, as with that in the above eighth embodiment, in accordance with the maximum pressure selected by the shuttle valve 55, and outputs, as the track communicating valve drive signal Xc, the front/swing operation signal Xf which is introduced through the line 304*b* when the hydraulic selector valve 308 is in the communicating position.

The other structure is essentially the same as that of the eighth embodiment.

In the above construction, the pilot pump 2, the delivery line 17, the relief valve 18, the line 309, the line 310, the hydraulic selector valve 308, the line 304*b*, the hydraulic selector valve 303, the signal line 306 and the signal line 305 constitute a switching signal output means for generating and outputting a switching signal to shift the first selector valve into the open state when both operation signals are introduced to the means through the first-track shuttle valve and the front shuttle valves.

In this embodiment thus constructed, since the operation signal pressure selected as the maximum pressure by the shuttle valve 68 is utilized just in a limited passage (line 304*a*) within the shuttle block 301A for being used for the swing brake cylinder 27 and the track communicating valve 26 which are control devices, the length of a transmission line of the operation signal pressure selected as the maximum pressure by the shuttle valve 68 is not so increased and therefore one or more corresponding flow control valves can be shifted with a good response. On the other hand, from the point of operating the swing brake cylinder 27 and the track communicating valve 26 which are control devices, since the control signal pressures (the front/swing operation signal Xf and the track communicating valve drive signal Xc) are generated by the hydraulic selector valves 308, 303 from the pressure of the pilot hydraulic source 2, 18, the control signal pressures can be provided at a sufficient flow rate; hence the swing brake cylinder 27 and the track communicating valve 26 can be operated with a better response.

Accordingly, in addition to the similar advantages as obtainable with the above eighth embodiment, this ninth embodiment can provide an advantage of enabling the swing brake cylinder 27 and the track communicating valve 26 to be shifted with a better response. Specifically, for the swing brake cylinder 27, the speed of releasing a swing brake is increased and the brake can be reliably released prior to the start-up of the swing motor 35, etc. For the track communicating valve 26, it is reliably shifted to the communicating position before starting to travel, resulting in that the excavator can travel with improved straightforwardness. Further, since the flow control valves can also be shifted with a good response, smooth operability can be achieved in the entirety of hydraulic control system.

While in the above eighth and ninth embodiments the flow control valve 5 for the right track is connected in tandem (with preference) upstream of the other flow control valves 6–8 and, upstream of the flow control valve 13 for the left track, the other flow control valves 9–12 are connected in tandem (with preference), the valve arrangement is not limited to the illustrated embodiment. Conversely, the flow control valve for the left track may be connected in tandem upstream of the other flow control valves and, upstream of the flow control valve for the right track, the other flow control valves may be connected in tandem with the input ports of the flow control valves for the left and right tracks connected to the communicating line 41. This case can also provide the similar advantages.

Further, the present invention is not limited to such a valve arrangement that one of the track flow control valves is disposed in tandem at the most upstream end of one valve group and the other track flow control valve is disposed in tandem at the most downstream end of the other valve group, as stated above. The present invention is also applicable to a valve arrangement modified such that the track flow control valves are each disposed in tandem at the most upstream end of each valve group and the input ports of the two track flow control valves are connected to the communicating line. This case can also provide the similar advantages.

According to the present invention, in a hydraulic circuit system which includes a control device operated by a control signal pressure in accordance with a maximum pressure detected by shuttle valves, a high-pressure system and a low-pressure system can be separated from each other to simplify a circuit configuration, reduce a production cost, and improve assembling efficiency. Also, since a pressure loss during transmission of the control signal pressure is reduced and the control device is operated without a delay in response, smooth operability of the control device can be achieved.

Furthermore, the control signal pressure can be generated without considerably increasing the length of a transmission line for the operation signal pressure, and the flow control valves and the control device can be both operated with a good response. As a result, smooth operability can be achieved in the entirety of the hydraulic circuit system. In addition, since a plurality of shuttle valves are arranged and connected within a shuttle block in a hierarchical structure, one or more required control signal pressures can be created with a minimum number of shuttle valves.

Consequently, the shuttle block can be made compact and the production cost can be reduced.

Moreover, according to the present invention, when providing an additional actuator later in the hydraulic circuit system, the control device corresponding to the additional actuator, such as a regulator for a hydraulic pump, can be simply controlled.

What is claimed is:

1. A hydraulic circuit system for a hydraulic working machine comprising at least one hydraulic pump, a plurality of actuators, a plurality of flow control valves for supplying a hydraulic fluid delivered from said at least one hydraulic pump to said plurality of actuators, a pilot hydraulic source, a plurality of pilot operating units for generating operation signal pressures from a pressure of said pilot hydraulic source to shift corresponding flow control valves, and a plurality of shuttle valves for selecting a maximum pressure for each of at least one of predetermined operation signal pressure groups selected from the operation signal pressures generated by said plurality of pilot operating units, said system producing at least one control signal pressure in accordance with the maximum pressure selected by said plurality of shuttle valves for each of said at least one predetermined operation signal pressure group, thereby operating at least one control device associated with any of said at least one hydraulic pump, said actuators and said flow control valves, wherein:

said plurality of shuttle valves for selecting said maximum pressure are all built in one shuttle block, and said control signal pressure is produced within said shuttle block and then output to said control device.

2. The hydraulic circuit system for a hydraulic working machine according to claim 1, further comprising a hydraulic selector valve operated in accordance with the maximum pressure selected by said plurality of shuttle valves from at least one of the predetermined operation signal pressure groups, thereby producing a corresponding control signal pressure from the pressure of said pilot hydraulic source, said hydraulic selector valve being also built in said shuttle block.

3. The hydraulic circuit system for a hydraulic working machine according to claim 1, wherein said plurality of shuttle valves select a maximum pressure for each of a plurality of predetermined operation signal pressure groups selected from the operation signal pressures generated by said plurality of pilot operating units, said shuttle block producing a plurality of control signal pressures in accordance with the maximum pressures each selected by said shuttle valves for each of said plurality of operation signal pressure groups, and output the control signal pressures respectively to a plurality of control devices.

4. The hydraulic circuit system for a hydraulic working machine according to claim 3, wherein said plurality of actuators include a swing motor for driving an upper swing structure of a hydraulic excavator to swing, said plurality of control devices include a swing brake unit for braking said swing motor, and said shuttle block outputs one of said plurality of control signal pressures to said swing brake unit for switching said swing brake unit to an inoperative position so that said swing brake unit is released from a braked state.

5. The hydraulic circuit system for a hydraulic working machine according to claim 3, wherein at least two hydraulic pumps are provided, said plurality of actuators include left and right track motors for driving a lower track structure of a hydraulic excavator to travel, said plurality of control devices include a track communicating valve capable of shifting between a cutoff position where said left and right track motors are separately connected to said two hydraulic pumps, respectively, and a communicating position where said left and right track motors are connected to one of said two hydraulic pumps in parallel, and said shuttle block outputs one of said plurality of control signal pressures to said track communicating valve for shifting said track communicating valve to said communicating position so that the hydraulic fluid delivered from said one hydraulic pump flows into said left and right track motors.

6. The hydraulic circuit system for a hydraulic working machine according to claim 3, wherein said hydraulic pump is a variable displacement hydraulic pump, said plurality of control devices include a regulator for controlling a capacity of said hydraulic pump, and said shuttle block outputs one of said plurality of control signal pressures to said regulator for operating said regulator to thereby control the capacity of said hydraulic pump.

7. The hydraulic circuit system for a hydraulic working machine according to claim 3, wherein:

said plurality of actuators include left and right track motors for driving a lower track structure of a hydraulic excavator to travel, a boom cylinder, an arm cylinder and a bucket cylinder for driving, respectively, a boom, an arm and a bucket of said hydraulic excavator, and a swing motor for driving an upper swing structure of said hydraulic excavator to swing with respect to said lower track structure, said plurality of pilot operating units include a right-track operating unit provided with a pair of pilot valves for selectively generating forward and rearward signal pressures for said right track motor, a left-track operating unit provided with a pair of pilot valves for selectively generating forward and rearward signal pressures for said left track motor, a bucket operating unit provided with a pair of pilot valves for selectively generating bucket-crowding and bucket-dumping signal pressures for said bucket cylinder, a boom operating unit provided with a pair of pilot valves for selectively generating boom-raising and boom-lowering signal pressures for said boom cylinder, an arm operating unit provided with a pair of pilot valves for selectively generating arm-crowding and arm-dumping signal pressures for said arm cylinder, and a swing operating unit provided with a pair of pilot valves for selectively generating swing-to-right and swing-to-left signal pressures for said swing motor, and said shuttle block incorporates therein a first shuttle valve for selecting a highest pressure of the signal pressures from the pair of pilot valves of said right-track operating unit, a second shuttle valve for selecting a highest pressure of the signal pressures from the pair of pilot valves of said left-track operating unit, a third shuttle valve for selecting a highest pressure of the signal pressures from the pair of pilot valves of said bucket operating unit, a fourth shuttle valve for selecting a highest pressure of the signal pressures from the pair of pilot valves of said boom operating unit, a fifth shuttle valve for selecting a highest pressure of the signal pressures from the pair of pilot valves of said arm operating unit, a sixth shuttle valve for selecting a highest pressure of the signal pressures from the pair of pilot valves of said swing operating unit, a seventh shuttle valve for selecting a highest pressure of the signal pressures selected by said fourth and fifth shuttle valves, an eighth shuttle valve for selecting a highest pressure of the signal pressures selected by said third and seventh shuttle valves, a ninth shuttle valve for selecting a highest pressure of the signal pressures selected by said seventh and sixth shuttle valves, a tenth shuttle valve for selecting a highest pressure of the signal pressures selected by said first and eighth shuttle valves as one of said maximum pressures of the plurality of operation signal pressure groups, an eleventh shuttle valve for selecting a highest pressure of the signal pressures selected by said second and ninth shuttle valves as another of said maximum pressures of the plurality of operation signal pressure groups, and a twelfth shuttle valve for selecting a highest pressure of the signal pressures selected by said eighth and ninth shuttle valves as still another of said maximum pressures of the plurality of operation signal pressure groups, said shuttle block producing a first pump control signal as one of said plurality of control signal pressures in accordance with the maximum pressure selected by said tenth shuttle valve, a second pump control signal as another of said plurality of control signal pressures in accordance with the maximum pressure selected by said eleventh shuttle valve, and a front/swing operation signal as still another of said plurality of control signal pressures in accordance with the maximum pressure selected by said twelfth shuttle valve.

8. The hydraulic circuit system for a hydraulic working machine according to claim 7, wherein said shuttle block further incorporates therein, as one of said plurality of shuttle valves, a thirteenth shuttle valve for selecting a highest pressure of the signal pressures selected by said first and second shuttle valves as still another of said maximum pressures of the plurality of operation signal pressure groups, and produces a track operation signal as still another of said plurality of control signal pressures in accordance with the maximum pressure selected by said thirteenth shuttle valve.

9. The hydraulic circuit system for a hydraulic working machine according to claim 1, wherein a reserve port is formed in a block body of said shuttle block, and said shuttle block incorporates therein a reserve shuttle valve for selecting a highest pressure of one of said maximum pressures selected by said plurality of shuttle valves from said predetermined operation signal pressure groups and a pressure at said reserve port.

10. The hydraulic circuit system for a hydraulic working machine according to claim 9, further comprising a reserve flow control valve connected to said at least one hydraulic pump, and a reserve pilot operating unit for converting the pilot pressure of said pilot hydraulic source into a signal pressure.

11. The hydraulic circuit system for a hydraulic working machine according to claim 1, wherein:

said at least one hydraulic pump is of the variable displacement type and least two hydraulic pumps are provided, including first and second hydraulic pumps, said plurality of shuttle valves select, of the operation signal pressures generated by said plurality of pilot operating units, a first maximum pressure in a group of those operation signal pressures related to said first hydraulic pump and a second maximum pressure in a group of those operation signal pressures related to said second hydraulic pump, and said control device includes first and second regulators operated by first and second control signal pressures produced in accordance with said first and second maximum pressures selected by said plurality of shuttle valves, respectively, for controlling capacities of said first and second hydraulic pumps, and at least two reserve ports including first and second reserve ports are formed in a block body of said shuttle block, and said shuttle block incorporates therein a first reserve shuttle valve for selecting a highest pressure of a pressure at said first reserve port and said first maximum pressure as said first control signal pressure, and a second reserve shuttle valve for selecting a highest pressure of a pressure at said second reserve port and said second maximum pressure as said second control signal pressure.

12. The hydraulic circuit system for a hydraulic working machine according to claim 1, wherein:

a plurality of hydraulic pumps are provided including third and fourth hydraulic pumps; said plurality of actuators include first and second track motors for driving a lower track structure of a hydraulic excavator to travel and at least one front actuator for driving a work front of said hydraulic excavator; said plurality of flow control valves include a first-track flow control valve for supplying a hydraulic fluid delivered from said third hydraulic pump to said first track motor, a front flow control valve for supplying hydraulic fluid delivered from at least said third hydraulic pump to said front actuator, and a second-track flow control valve for supplying a hydraulic fluid delivered from said fourth hydraulic pump to said second track motor, said first-track flow control valve being so connected that hydraulic fluid delivered from said third hydraulic pump is supplied to said first track motor with more preference than through said front flow control valve; said plurality of pilot operating units include a first-track pilot operating unit and a front pilot operating unit for operating, respectively, said first-track flow control valve and said front flow control valve; and said plurality of shuttle valves include a first-track shuttle valve for detecting a first-track maximum pressure of operation signal pressures generated by said first-track pilot operating unit and a front shuttle valve for detecting a front maximum pressure of operation signal pressures generated by said front pilot operating unit, and said system further comprises a communicating line for communicating a hydraulic fluid supply line for said first-track flow control valve and a hydraulic fluid supply line for said second-track flow control valve with each other, a first selector valve capable of opening and closing said communicating line, a check valve disposed in said communicating line for allowing hydraulic fluid to flow from a side of said first-track flow control valve to a side of said second-track flow control valve, but blocking a reverse flow of hydraulic fluid, and switching signal output means for generating and outputting a switching signal to shift said first selector valve into an open state when corresponding maximum pressure signals are both introduced to said switching signal output means through said first-track shuttle valve and said front shuttle valve.

13. The hydraulic circuit system for a hydraulic working machine according to claim 12, wherein said switching signal output means includes at least a second selector valve shifted in accordance with said first-track maximum pressure and, as an option, a third selector valve shifted in accordance with said front maximum pressure, at least said second selector valve being built in said one shuttle block.

14. The hydraulic circuit system for a hydraulic working machine according to claim 13, wherein said second selector valve is shifted between a communicating position and a cutoff position in accordance with said first-track track maximum pressure, and when held in said communicating position, said second selector valve outputs said front maximum pressure as said switching signal to said first selector valve.

15. The hydraulic circuit system for hydraulic working machine according to claim 12, wherein said switching signal output means includes a second selector valve shifted between a communicating position and a cutoff position in accordance with said first-track maximum pressure and a third selector valve shifted between a communicating position and a cutoff position in accordance with said front maximum pressure, said third selector valve establishing a connection to introduce a pilot pressure of said pilot hydraulic source to said second selector valve when held in said communicating position, said second selector valve establishing a connection to output the pilot pressure of said pilot hydraulic source that is introduced from said third selector valve, as said switching signal to said first selector valve when held in said communicating position, said second and third selector valves being built in said one shuttle block.

* * * * *